US006336717B1

(12) United States Patent
Shimada et al.

(10) Patent No.: US 6,336,717 B1
(45) Date of Patent: Jan. 8, 2002

(54) INK JET RECORDING HEAD AND INK JET RECORDING APPARATUS

(75) Inventors: Masato Shimada; Shinri Sakai; Souichi Moriya; Yoshinao Miyata; Yutaka Furuhata, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/326,699

(22) Filed: Jun. 7, 1999

(30) Foreign Application Priority Data

| | | |
|---|---|---|
| Jun. 8, 1998 | (JP) | 10-159327 |
| Jul. 27, 1998 | (JP) | 10-211562 |
| Jul. 29, 1998 | (JP) | 10-214193 |
| Aug. 25, 1998 | (JP) | 10-239237 |
| Nov. 4, 1998 | (JP) | 10-313659 |
| Jan. 26, 1999 | (JP) | 11-017673 |
| Mar. 18, 1999 | (JP) | 11-073025 |
| Mar. 18, 1999 | (JP) | 11-073305 |
| Mar. 24, 1999 | (JP) | 11-079894 |
| Mar. 24, 1999 | (JP) | 11-079934 |
| Mar. 24, 1999 | (JP) | 11-079944 |
| May 14, 1999 | (JP) | 11-134898 |

(51) Int. Cl.[7] ..... B41J 2/045
(52) U.S. Cl. ..... 347/71
(58) Field of Search ..... 347/68, 71, 72, 347/69, 65

(56) References Cited

U.S. PATENT DOCUMENTS 4,584,590 A * 4/1986 Fischbeck et al. ..... 347/69
5,376,857 A * 12/1994 Takeuchi et al. ..... 310/328

FOREIGN PATENT DOCUMENTS

| | | | |
|---|---|---|---|
| EP | 0 561 616 A2 | 9/1993 | H01L/41/04 |
| EP | 0 615 294 A1 | 9/1994 | H01L/41/09 |
| EP | 0 755 791 A2 | 1/1997 | B41J/2/14 |
| EP | 0 799 700 A2 | 10/1997 | B41J/2/14 |
| EP | 0 839 653 A2 | 5/1998 | B41J/2/045 |
| GB | 2 282 992 | 4/1995 | B41J/2/045 |
| JP | 5-267742 | 10/1993 | H01L/41/09 |
| JP | 5-286131 | 11/1993 | B41J/2/045 |
| JP | 10-226068 | 8/1998 | B41J/2/045 |
| JP | 10-296974 | 11/1998 | B41J/2/045 |
| JP | 11-188867 | 7/1999 | B41J/2/045 |

OTHER PUBLICATIONS

Two (2) Communications from Foreign Patent Offices.

* cited by examiner

*Primary Examiner*—Thinh Nguyen
(74) *Attorney, Agent, or Firm*—Sughrue Mion, PLLC

(57) ABSTRACT

An ink jet recording head comprises a pressure generating chamber communicating with a nozzle opening, and a piezoelectric element a lower electrode provided on an area facing the pressure generating chamber via an insulating layer, a piezoelectric layer provided on the lower electrode, and an upper electrode provided on the piezoelectric layer. At least both ends of the lower electrode in a width direction thereof are positioned within the area facing the pressure generating chamber, and the piezoelectric layer covers sides of both ends of the lower electrode in the width direction thereof.

54 Claims, 26 Drawing Sheets

INK JET RECORDING HEAD AND INK JET RECORDING APPARATUS

BACKGROUND OF THE INVENTION

This invention relates to an ink jet recording head wherein a piezoelectric element is formed via a diaphragm in a part of each of pressure generating chambers communicating with nozzle openings for jetting ink drops and ink drops are jetted by displacement of the piezoelectric element, and an ink jet recording apparatus comprising the ink jet recording head.

The following two types of ink jet recording heads, each wherein a part of a pressure generating chamber communicating with a nozzle opening for jetting an ink drop is formed of a diaphragm and the diaphragm is deformed by a piezoelectric element for pressurizing ink in the pressure generating chamber for jetting an ink drop through the nozzle opening, are commercially practical: One uses a piezoelectric actuator in a vertical vibration mode in which the piezoelectric element is expanded and contracted axially and the other uses a piezoelectric actuator in a deflection vibration mode.

With the former, the volume of the pressure generating chamber can be changed by abutting an end face of the piezoelectric element against the diaphragm and a head appropriate for high-density printing can be manufactured, but a difficult step of dividing the piezoelectric element like comb teeth matching the arrangement pitch of the nozzle openings and work of positioning and fixing the piezoelectric element divisions in the pressure generating chambers are required and the manufacturing process is complicated.

In contrast, with the latter, the piezoelectric element can be created and attached to the diaphragm by executing a comparatively simple process of putting a green sheet of a piezoelectric material matching the form of the pressure generating chamber and baking it, but a reasonable area is required because deflection vibration is used; high-density arrangement is difficult to make.

On the other hand, to solve the problem of the latter recording head, Japanese Patent Publication No. 5-286131A proposes an art wherein an uniform piezoelectric material layer is formed over the entire surface of a diaphragm according to a film formation technique and is divided to a form corresponding to a pressure generating chamber according to a lithography technique for forming a piezoelectric element separately for each pressure generating chamber.

This eliminates the need for work of putting the piezoelectric element on the diaphragm and the piezoelectric element can be created by the lithography method, an accurate and simple technique. In addition, the piezoelectric element can be thinned and high-speed drive is enabled.

However, in the manufacturing method according to the thin-film technique and the lithography method described above, after thin film patterning, pressure generating chambers are formed. At the time, a diaphragm is deflected to the pressure generating chamber side by the effect of relaxation of the internal stresses in an upper electrode and piezoelectric layers and the deflection remains as the initial deformation of the diaphragm.

Further, in a piezoelectric vibrator manufactured by the thin-film technique and the lithography method, in which arm portions of a lower electrode are removed by the patterning, a piezoelectric layer becomes thinner. Thus, the strength of the dielectric breakdown on both sidewalls in width direction of the lower electrode becomes lower and thereby the dielectric breakdown occurs easily.

SUMMARY OF THE INVENTION

It is therefore an object of the present invention to provide an ink jet recording head, wherein the dielectric breakdown of the piezoelectric layer is prevented and wherein the initial deflection amount of a diaphragm is decreased, and an ink jet recording apparatus comprising the ink jet recording head.

In order to achieve the above object, according to a first aspect of the present invention, there is provided an ink jet recording head comprising: a pressure generating chamber communicating with a nozzle opening; and a piezoelectric element a lower electrode provided on an area facing the pressure generating chamber via an insulating layer, a piezoelectric layer provided on the lower electrode, and an upper electrode provided on the piezoelectric layer, wherein at least both ends of the lower electrode in a width direction thereof are positioned within the area facing the pressure generating chamber, and the piezoelectric layer covers sides of both ends of the lower electrode in the width direction thereof.

In the first aspect, the both side wall of the lower electrode in the width direction thereof patterned in the pressure generating chamber are covered with the piezoelectric layer, thus the strength of the dielectric breakdown thereon is improved and the insulating layer and the piezoelectric layer are brought into intimate contact with each other, whereby the initial deflection amount of a diaphragm is decreased.

According to a second aspect of the present invention, in the ink jet recording head of the first aspect, crystal direction of the piezoelectric layer is preferentially oriented.

In the second aspect, the piezoelectric layer is formed in a thin film process, so that crystal is preferentially oriented.

According to a third aspect of the present invention, in the ink jet recording head of the second aspect, the piezoelectric layer has a columnar crystal structure.

In the third aspect, the piezoelectric layer is formed in a thin film process, so that the piezoelectric layer has a columnar crystal structure.

According to a fourth aspect of the present invention, in the ink jet recording head of the first to third aspect, the insulating layer in the area under the area where the lower electrode is formed is thicker than any other area.

In the fourth aspect, the piezoelectric layer is at a position distant from the neutral axis of bend caused by drive of the piezoelectric element, so that displacement efficiency is improved.

According to a fifth aspect of the present invention, in the ink jet recording head of any of the first to fourth aspects, the top of the insulating layer in a thickness direction thereof is made of an adhesive insulating layer made of a material having a good adhesion with the piezoelectric layer. The adhesive insulating layer is adhered with the piezoelectric layer covering sides of both ends of the lower electrode in the width direction thereof.

In the fifth aspect, the lower electrode in the area facing the pressure generating chamber is covered completely with the piezoelectric layer and the strength of the dielectric breakdown on the sidewall is furthermore improved.

According to a sixth aspect of the present invention, in the ink jet recording head of the fifth aspect, the material of the adhesive insulating layer is made of either one of an oxide or a nitride of at least one element selected from composite element of the piezoelectric layer.

In the sixth aspect, the intimate contact property between the insulating layer and the piezoelectric layer is improved.

According to a seventh aspect of the present invention, in the ink jet recording head of the sixth aspect, the adhesive insulating layer is made of zirconium oxide.

In the seventh aspect, the rigidity of the insulating layer is improved and the durability is enhanced.

According to an eighth aspect of the present invention, in the ink jet recording head of any of the fifth to seventh aspects, the insulating layer is made of the adhesive insulating layer.

In the eighth aspect, the insulating layer is formed easily and the manufacturing process is simplified.

According to a ninth of the present invention, in the ink jet recording head of the eighth aspect, the insulating layer is formed directly on a silicon monocrystalline substrate.

In the ninth aspect, the zirconium oxide film shows sufficient durability even solely.

According to a tenth aspect of the present invention, in the ink jet recording head of the eighth aspect, the insulating layer is formed on a silicon dioxide film formed on the silicon monocrystalline substrate. The portions of the silicon dioxide film corresponding to the pressure generating chambers are removed.

In the tenth aspect, the displacement efficiency of an actuator can be enhanced.

According to an eleventh aspect of the present invention, in the ink jet recording head of any of the fifth to tenth aspects, the piezoelectric layer is made of PZT and the adhesive insulating layer is made of zirconium oxide.

In the eleventh aspect, the intimate contact property between the piezoelectric layer and the insulating film is improved.

According to a twelfth aspect of the present invention, in the ink jet recording head of any of the first to eleventh aspects, both ends of the piezoelectric layer in a width direction thereof are positioned in the area facing the pressure generating chamber.

In the twelfth aspect, the areas corresponding to both sides in the width direction the pressure generating chamber become thin, so that the displacement amount of the diaphragm is increased.

According to a thirteenth aspect of the present invention, in the ink jet recording head of any of the first to eleventh aspects, the piezoelectric layer is extended to the areas corresponding to peripheral walls on both sides in the width direction of the pressure generating chamber and the piezoelectric layer on the lower electrode is thicker than any other area.

In the thirteenth aspect, the lower electrode is covered with the piezoelectric layer reliably, so that the strength of the dielectric breakdown on the sidewall is improved and the strength is also increased. Since the end of the piezoelectric layer does not exist in the arm part, initial failure is avoided and durability is also improved.

According to a fourteenth aspect of the present invention, in the ink jet recording head of any of the first to eleventh aspects, the relationship among width $W_{TE}$ of the upper electrode, width $W_{BE}$ of the lower electrode, and thickness T of the piezoelectric layer satisfies:

$$(W_{BE}-5T)<W_{TE}<(W_{BE}+5T).$$

In the fourteenth aspect, the piezoelectric layer sandwiched between the upper and lower electrodes is driven effectively.

According to a fifteenth aspect of the present invention, in the ink jet recording head of any of the first to fourteenth aspects, wherein the end of the lower electrode is disposed at one end portion in a longitudinal direction of the pressure generating chamber. The piezoelectric layer and the upper electrode are extended to the outside of the end of the lower electrode in the longitudinal direction of the pressure generating chamber. The end of the lower electrode constitutes one end of a piezoelectric active part which is a substantial driving part of the piezoelectric layer.

In the fifteenth aspect, dielectric breakdown of the piezoelectric layer is prevented without interfering with drive of the piezoelectric active part.

According to a sixteenth aspect of the present invention, in the ink jet recording head of the fifteenth aspect, the end of the piezoelectric active part is positioned inside from the peripheral wall of the pressure generating chamber.

In the sixteenth aspect, dielectric breakdown of the piezoelectric layer is prevented without interfering with drive of the piezoelectric active part.

According to a seventeenth aspect of the present invention, in the ink jet recording head of any of the first to fourteenth aspects, the end of the lower electrode is disposed at one end portion in a longitudinal direction of the pressure generating chamber. An end of the upper electrode is disposed inside from the end of the lower electrode in the longitudinal direction of the pressure generating chamber. The piezoelectric layer is extended to the outside of the end of the lower electrode in the longitudinal direction of the pressure generating chamber. The end of the upper electrode constitutes one end of a piezoelectric active part which is a substantial drive part of the piezoelectric layer.

In the seventeenth aspect, a distance can be kept between the end of the piezoelectric active part and the end of the lower electrode and dielectric breakdown caused by concentration of electric field, etc., at the end of in the longitudinal direction of the piezoelectric active part is prevented.

According to an eighteenth aspect of the present invention, in the ink jet recording head of any of the fifteenth to seventeenth aspects, a discontinuous lower electrode film discontinuous with the lower electrode is provided in an area facing the boundary between an end and peripheral wall of the pressure generating chamber.

In the eighteenth aspect, the rigidity of the diaphragm in the portion where the piezoelectric layer and the upper electrode are drawn to the area outside the pressure generating chamber is held high and destruction of the diaphragm and the piezoelectric layer in the portion is prevented.

According to a nineteenth aspect of the present invention, in the ink jet recording head of the eighteenth aspect, a wiring lower electrode which is made discontinuous with the discontinuous lower electrode and is connected at one end to external wiring is provided for each piezoelectric element.

In the nineteenth aspect, wiring can be drawn easily and efficiently from the piezoelectric active part.

According to a twentieth aspect of the present invention, in the ink jet recording head of any of the fifteenth to eighteenth aspects, the lower electrode is extended from an opposite end of the piezoelectric active part to the top of the peripheral wall of the pressure generating chamber.

In the twentieth aspect, the piezoelectric elements can be wired easily.

According to a twenty-first aspect of the present invention, in the ink jet recording head of the twentieth aspect, the lower electrode has a wider part at least wider than the pressure generating chamber in an area facing the proximity of one end of the pressure generating chamber and the wider part is extended from the end in the longitudinal direction of the pressure generating chamber to the top of the peripheral wall.

In the twenty-first aspect, the rigidity of the diaphragm in the proximity of the end of the pressure generating chamber is increased and durability is improved.

According to a twenty-second aspect of the present invention, in the ink jet recording head of any of the first to twenty-first aspects, the piezoelectric layer, and one of the upper electrode and a lead electrode connected onto the upper electrode are extended from the longitudinal direction of the area facing the pressure generating chamber to the outside thereof.

In the twenty-second aspect, the connection part of the upper electrode and external wiring can be formed easily in the area facing the peripheral wall of the pressure generating chamber.

According to a twenty-third aspect of the present invention, in the ink jet recording head of the twenty-second aspect, the direction that the lower electrode extends to the top of the peripheral wall differs from the direction that the piezoelectric layer, and one of the upper electrode and the load electrode connected onto the upper electrode extend to the top of the peripheral wall.

In the twenty-third aspect, the piezoelectric active part driven by applying a voltage exists in the area facing the pressure generating chamber and wiring can be drawn easily without requiring an inter-layer insulating film or a contact hole.

According to a twenty-fourth aspect of the present invention, in the ink jet recording head of the twenty-second aspect, the direction that the lower electrode extends to the top of the peripheral wall is the same as the direction that the piezoelectric layer, and one of the upper electrode and the lead electrode connected onto the upper electrode extend to the top of the peripheral wall.

In the twenty-fourth aspect, wiring can be drawn easily without requiring an inter-layer insulating film or a contact hole.

According to a twenty-fifth aspect of the present invention, in the ink jet recording head of the twenty-third or twenty-fourth aspect, either one of the lower electrode or the upper electrode is a common electrode.

In the twenty-fifth aspect, the piezoelectric elements can be wired easily.

According to a twenty-sixth aspect of the present invention, in the ink jet recording head of any of the first to twentieth aspects, the lower electrode is extended from the proximity of at least one end portion in a longitudinal direction of the area facing the pressure generating chamber to the outside in the width direction to form a common electrode.

In the twenty-sixth aspect, wiring can be drawn easily without requiring an inter-layer insulating film or a contact hole.

According to a twenty-seventh aspect of the present invention, in the ink jet recording head of any of the first to twenty-sixth aspects, the piezoelectric layer and the upper electrode are patterned in batch.

In the twenty-seventh aspect, the piezoelectric elements can be formed comparatively easily and the manufacturing process is simplified.

According to a twenty-eighth aspect of the present invention, in the ink jet recording head of any of the first to twenty-first aspects, both ends of the piezoelectric layer in the longitudinal direction thereof are patterned so as to be in the areas facing the pressure generating chambers and the upper electrode is continuously formed so as to cross the pressure generating chambers crossing in the width direction to form a common electrode.

In the twenty-eighth aspect, wiring can be drawn easily without requiring an inter-layer insulating film or a contact hole.

According to a twenty-ninth aspect of the present invention, in the ink jet recording head of any of the first to twenty-seventh aspects, a remaining part made of the same layer as the lower electrode is provided on tops of partitions on both sides in the width direction of the pressure generating chamber.

In the twenty-ninth aspect, the lower electrode removal area lessens, so that the piezoelectric layer is formed on the patterned lower electrode in a substantially uniform film thickness.

According to a thirtieth aspect of the present invention, in the ink jet recording head of the twenty-ninth aspect, a discontinuous lower electrode discontinuous with the lower electrode is provided on the outside of one end portion of the piezoelectric active part and the remaining part is extended continuously from the discontinuous lower electrode.

In the thirtieth aspect, the spacing between the lower electrode making up a part of the piezoelectric element and the remaining part can be made narrow and the piezoelectric layer is formed in a uniform film thickness more reliably.

According to a thirty-first aspect of the present invention, in the ink jet recording head of the twenty-ninth aspect, the remaining part is provided continuously with the lower electrode forming a part of the piezoelectric element.

In the thirty-first aspect, the spacing between the lower electrode making up a part of the piezoelectric element and the remaining part can be made comparatively narrow and the piezoelectric layer is formed in a uniform film thickness.

According to a thirty-second aspect of the present invention, in the ink jet recording head of any of the twenty-ninth to thirty-first aspects, the spacing between an end face in the width direction of the lower electrode and an end face in a width direction of the remaining part is wider than the thickness of the piezoelectric layer and is narrower than the width of the lower electrode.

In the thirty-second aspect, the film thickness of the piezoelectric layer in the width direction thereof becomes substantially uniform and the piezoelectric characteristic is not degraded.

According to a thirty-third aspect of the present invention, in the ink jet recording head of any of the twenty-ninth to thirty-second aspects, an end in a longitudinal direction of the piezoelectric layer is disposed in the proximity of the end portion of the pressure generating chamber where the lower electrode is extended to the top of the peripheral wall and the distance from that end to a part where the lower electrode extended to the outside becomes wider is wider than the thickness of the piezoelectric layer and is narrower than the width of the lower electrode.

In the thirty-third aspect, the film thickness of the piezoelectric layer in the proximity of the end in the longitudinal direction of the pressure generating chamber becomes uniform and if the piezoelectric layer is patterned, the lower electrode therebelow does not become thin.

According to a thirty-fourth aspect of the present invention, in the ink jet recording head of any of the twenty-ninth to thirty-third aspects, the remaining part has a width which is 50% or more of the width of the partition between the adjacent pressure generating chambers.

In the thirty-fourth aspect, the remaining part is formed in a predetermined width, whereby the piezoelectric layer is formed in a uniform film thickness more reliably.

According to a thirty-fifth aspect of the present invention, in the ink jet recording head of any of the twenty-ninth to thirty-fourth aspects, the lower electrode and the remaining part are formed in an area of a width of 50% or more of the area corresponding to the pressure generating chambers placed side by side and the partitions on both sides of the pressure generating chambers in the width direction thereof.

In the thirty-fifth aspect, the lower electrode and the remaining part are set to predetermined dimensions, whereby the film thickness of the piezoelectric layer becomes uniform reliably.

According to a thirty-sixth aspect of the present invention, in the ink jet recording head of any of the twenty-ninth to thirty-third aspects, the lower electrode and the remaining part are formed in an area of 50% or more of all area of the flow passage formation substrate.

In the thirty-sixth aspect, the lower electrode and the remaining part are set to predetermined dimensions, whereby the film thickness of the piezoelectric layer becomes uniform reliably.

According to a thirty-seventh aspect of the present invention, in the ink jet recording head of any of the first to thirty-sixth aspects, the crystalline structure of the piezoelectric layer on the lower electrode is substantially the same as that on the insulating layer.

In the thirty-seventh aspect, the crystalline state of the piezoelectric layer formed on the insulating layer becomes the same as that of the piezoelectric layer formed on the lower electrode, so that cracks do not occur and an abnormal stress does not occur on pattern boundaries either.

According to a thirty-eighth aspect of the present invention, in the ink jet recording head of the thirty-seventh aspect, crystal seed as a nucleus of crystal of the piezoelectric layer is formed on a surface of the insulating layer.

In the thirty-eighth aspect, the crystal structure of the piezoelectric layer is aligned in one orientation and is substantially uniformly formed owing to the crystal seed and occurrence of cracks, etc., is prevented.

According to a thirty-ninth aspect of the present invention, in the ink jet recording head of the thirty-eighth aspect, the crystal seed is formed like islands.

In the thirty-ninth aspect, the crystal of the piezoelectric layer is grown from the crystal seed formed like islands.

According to a fortieth aspect of the present invention, in the ink jet recording head of any of the eighteenth to thirty-ninth aspects, a second insulating layer is provided on the outside of the end of the lower electrode.

In the fortieth aspect, the piezoelectric layer does not become thin in the proximity of the end of the lower electrode and dielectric breakdown of the piezoelectric layer caused by concentration of electric field is prevented.

According to a forty-first aspect of the present invention, in the ink jet recording head of the fortieth aspect, the second insulating layer has substantially the same film thickness as the lower electrode.

In the forty-first aspect, the level difference between the lower electrode and the second insulating layer is small and the piezoelectric layer of a substantially uniform film thickness can be formed thereon.

According to a forty-second aspect of the present invention, in the ink jet recording head of the fortieth or forty-first aspect, the second insulating layer is made of an insulating material different from that of the insulating layer.

In the forty-second aspect, the second insulating layer delivers a function regardless of the type of insulating material.

According to a forty-third aspect of the present invention, in the ink jet recording head of any of the eighteenth to thirty-ninth aspects, a thick film part is provided on the insulating layer on the outside of the end of the lower electrode.

In the forty-third aspect, the piezoelectric layer does not become thin in the proximity of the end of the lower electrode, so that dielectric breakdown of the piezoelectric layer caused by concentration of electric field can be prevented.

According to a forty-fourth aspect of the present invention, in the ink jet recording head of the forty-third aspect, the thick film part has substantially the same film thickness as the lower electrode.

In the forty-fourth aspect, the level difference between the lower electrode and the thick film part is small and the piezoelectric layer of a substantially uniform film thickness can be formed thereon.

According to a forty-fifth aspect of the present invention, in the ink jet recording head of any of the eighteenth to thirty-ninth aspects, a film tapering part where film thickness of the lower electrode is gradually decreased toward the outside of the piezoelectric active part is provided at the end of the lower electrode.

In the forty-fifth aspect, the film tapering part is provided at the end of the lower electrode, thus the piezoelectric layer formed in the proximity of the end of the lower electrode does not become thin and dielectric breakdown in the proximity of the end of the piezoelectric active part is prevented.

According to a forty-sixth aspect of the present invention, in the ink jet recording head of the forty-fifth aspect, the film tapering part forms a slope where the film thickness of the lower electrode is gradually decreased.

In the forty-sixth aspect, the piezoelectric layer is formed along the slope of the film tapering part and the piezoelectric layer at the end of the piezoelectric active part does not become thin.

According to a forty-seventh aspect of the present invention, in the ink jet recording head of the forty-fifth aspect, the film tapering part is a part where the film thickness of the lower electrode is gradually decreased stepwise.

In the forty-seventh aspect, the piezoelectric layer is formed along the form of the film tapering part and becomes substantially the same film thickness as any other portion.

According to a forty-eighth aspect of the present invention, in the ink jet recording head of the forty-fifth aspect, the film tapering part forms a slanting curved surface where the film thickness of the lower electrode is gradually decreased continuously.

In the forty-eighth aspect, the piezoelectric layer is formed along the form of the film tapering part and becomes substantially the same film thickness as any other portion.

According to a forty-ninth aspect of the present invention, in the ink jet recording head of any of the forty-fifth to forty-eighth aspects, a portion of the piezoelectric layer formed on the film tapering part is thicker than any other portion.

In the forty-ninth aspect, concentration of electric field, etc., of the piezoelectric layer in the proximity of the end of the piezoelectric active part does not occur and dielectric breakdown is prevented.

According to a fiftieth aspect of the present invention, in the ink jet recording head of any of the eighteenth to forty-ninth aspects, the other end of the piezoelectric active part has a similar structure to that of the one end thereof.

In the fiftieth aspect, like one end of the piezoelectric active part, the other end is also prevented from being destroyed.

According to a fifty-first aspect of the present invention, in the ink jet recording head of any of the eighteenth to forty-ninth aspects, the other end of the piezoelectric active part is formed by the ends of the piezoelectric layer and the upper electrode and is covered with a discontinuous piezoelectric layer discontinuous with the piezoelectric layer.

In the fifty-first aspect, the end of the piezoelectric active part is protected by the discontinuous piezoelectric layer and the piezoelectric layer and the upper electrode are prevented from peeling, etc.

According to a fifty-second aspect of the present invention, in the ink jet recording head of any of the eighteenth to forty-ninth aspects, the other end of the piezoelectric active part is formed by the ends of the piezoelectric layer and the upper electrode and is fixed with an adhesive.

In the fifty-second aspect, the end of the piezoelectric active part is fixed and the piezoelectric layer and the upper electrode are prevented from peeling, etc.

According to a fifty-third aspect of the present invention, in the ink jet recording head of any of the first to fifty-second aspects, the pressure generating chambers are formed by anisotropic etching and the lower electrode, piezoelectric, and upper electrode layers are formed by film formation and lithography method.

In the fifty-third aspect, ink jet recording heads each having high-density nozzle openings can be manufactured in large quantities and comparatively easily.

According to a fifty-fourth aspect of the present invention, there is provided an ink jet recording apparatus comprising an ink jet recording head of any of the first to fifty-third aspects.

In the fifty-third aspect, an ink jet recording apparatus which is improved in the head drive efficiency and can well jet ink can be provided.

DETAILED DESCRIPTION OF THE PREFERRED EMBODIMENTS

Referring now to the accompanying drawings, there are shown preferred embodiments of the present invention.

Figure 1:
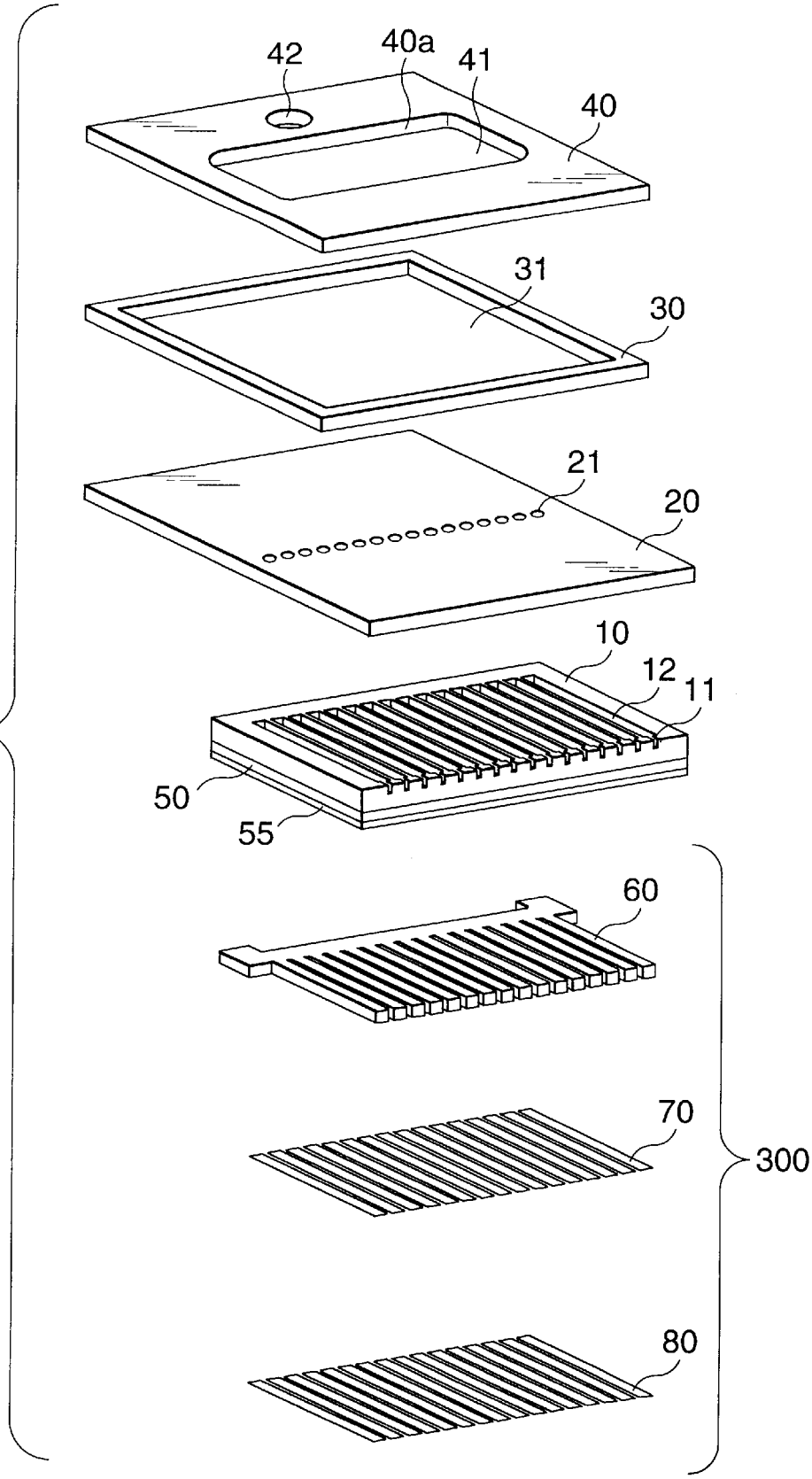
FIG. 1 is an exploded perspective view of an ink jet recording head according to a first embodiment of the present invention.
Figure 2A:
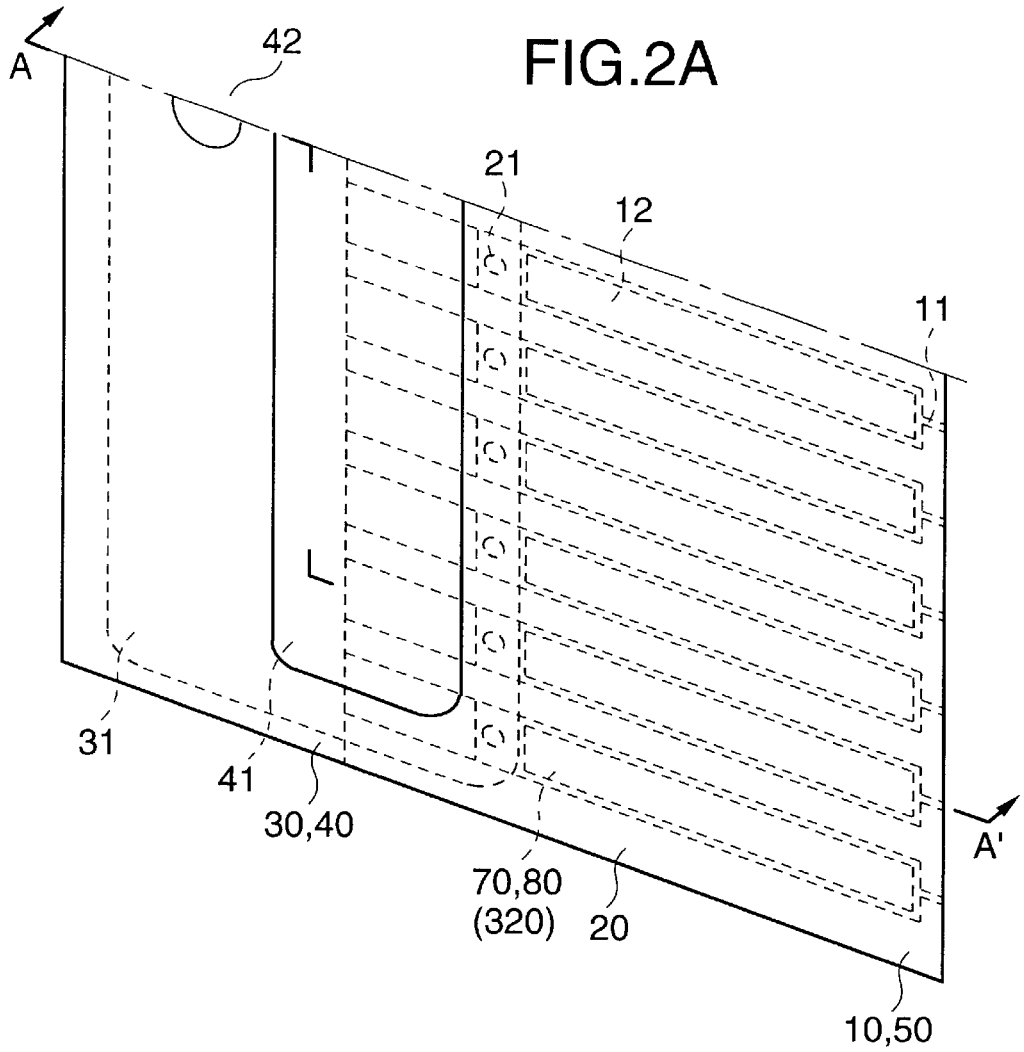
FIGS. 2A and 2B are a plan view and a sectional view of the ink jet recording head according to the first embodiment of the present invention shown in FIG. 1.
Figure 2B:
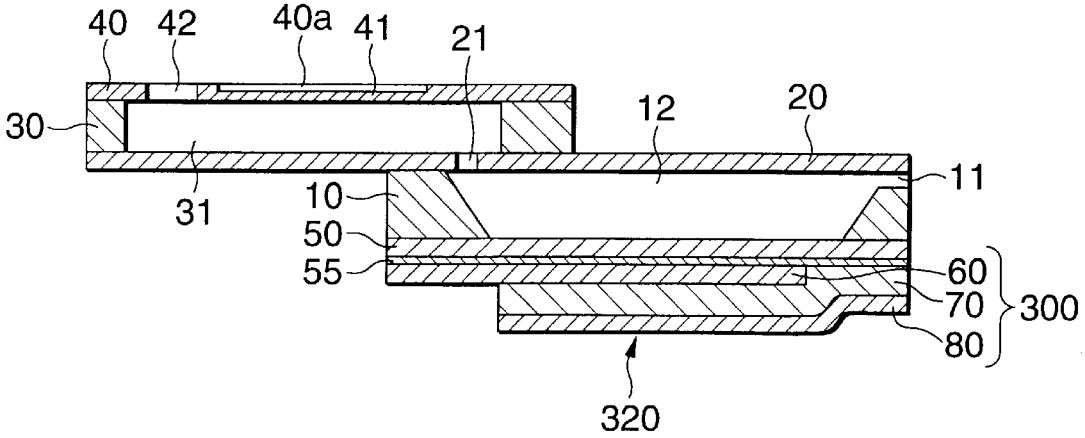

FIG. 1 is an exploded perspective view to show an ink jet recording head according to a first embodiment of the present invention. FIG. 2A is a plan view of the ink jet recording head shown in FIG. 1 and FIG. 2B is a sectional view to show the sectional structure in a longitudinal direction of one pressure generating chamber.

A flow passage formation substrate 10 is made of a silicon monocrystalline substrate having <110> direction of the crystal surface orientation in the embodiment. Normally, a substrate about 150–300 $\mu$m thick is used as the flow passage formation substrate 10; preferably a substrate about 180–280

μm thick, more preferably a substrate about 220 μm thick is used because the arrangement density can be made high while the rigidity of a partition between contiguous pressure generating chambers is maintained.

The flow passage formation substrate 10 is formed on one face with an opening face and on an opposite face with an elastic film 50 of 0.1–2 μm thick made of silicon dioxide previously formed by thermal oxidation.

On the other hand, the flow passage formation substrate 10 is formed on the opening face with nozzle openings 11 and pressure generating chambers 12 by anisotropically etching the silicon monocrystalline substrate.

The anisotropic etching is executed by using the nature that if the silicon monocrystalline substrate is immersed in an alkaline solution such as KOH, it gradually erodes, a first <111> plane perpendicular to a <110> plane and a second <111> plane forming about 70 degrees with the first <111> plane and forming about 35 degrees with the <110> plane appear, and the etching rate of the <111> plane is about 1/180 that of the <110> plane. By the anisotropic etching, accurate work can be executed based on depth work like a parallelogram formed by the two first <111> planes and the two second <111> planes tilted, and the pressure generating chambers 12 can be arranged at a high density.

In the embodiment, the long sides of each pressure generating chamber 12 are formed by the first <111> planes and the short sides are formed by the second <111> planes. The pressure generating chambers 12 are formed by etching the silicon monocrystalline substrate to the elastic film 50. The amount of immersing the elastic film 50 in the alkaline solution for etching the silicon monocrystalline substrate is extremely small.

On the other hand, each nozzle opening 11 communicating with one end of each pressure generating chambers 12 is formed narrower and shallower than the pressure generating chamber 12. That is, the nozzle openings 11 are made by etching the silicon monocrystalline substrate to an intermediate point in the thickness direction (half etching). The half etching is executed by adjusting the etching time.

The size of each pressure generating chamber 12 for giving ink drop jet pressure to ink and the size of each nozzle opening 11 for jetting ink drops are optimized in response to the jetted ink drop amount, jet speed, and jet frequency. For example, to record 360 ink drops per inch, the nozzle opening 11 needs to be made with accuracy with a groove width of several ten μm.

The pressure generating chambers 12 and a common ink chamber 31 (described later) are made to communicate with each other via ink supply communication ports 21 formed at positions of a seal plate 20 (described later) corresponding to one end of the each pressure generating chamber 12. Ink is supplied from the common ink chamber 31 through the ink supply communication ports 21 to the pressure generating chambers 12.

Figure 3A:
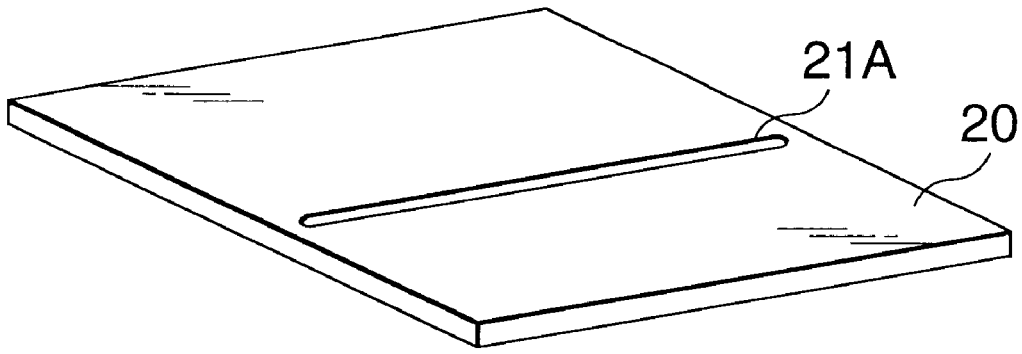
FIGS. 3A and 3B are drawings to show modified examples of a seal plate in FIG. 1.
Figure 3B:
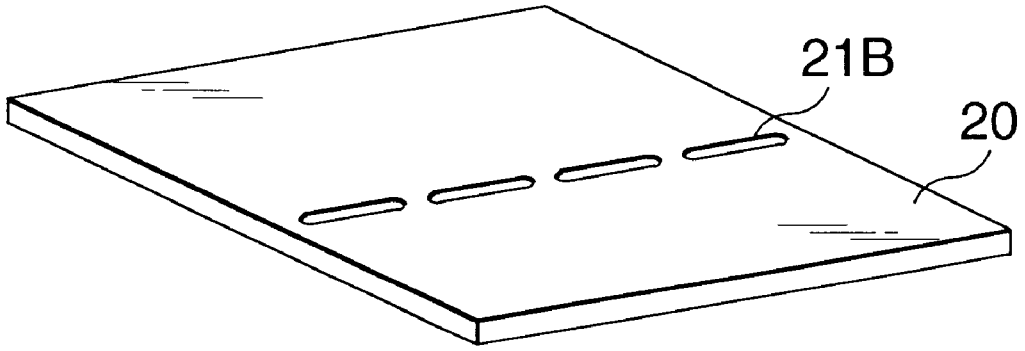

The seal plate 20 is made of glass ceramic having a thickness of 0.1–1 mm and a linear expansion coefficient of $2.5–4.5\times10^{-6}$ [/° C.] at 300° C. or less, for example, formed with the ink supply communication ports 21 corresponding to the pressure generating chambers 12. The ink supply communication ports 21 may be one slit hole 21A or a plurality of slit holes 21B crossing the neighborhood of the ink supply side ends of the pressure generating chambers 12 as shown in FIG. 3A or 3B. One face of the seal plate 20 fully covers one face of the flow passage formation substrate 10, namely, the seal plate 20 also serves as a reinforcing plate for protecting the silicon monocrystalline substrate from shock and external force. An opposite face of the seal plate 20 forms one wall face of the common ink chamber 31.

A common ink chamber formation substrate 30 forms a peripheral wall of the common ink chamber 31; it is made by stamping a stainless steel having a proper thickness responsive to the number of nozzle openings and the ink drop jet frequency. In the embodiment, the common ink chamber formation substrate 30 is 0.2 mm thick.

An ink chamber side plate 40 is made of a stainless substrate and one face thereof forms one wall face of the common ink chamber 31. The ink chamber side plate 40 is formed with a thin wall 41 by forming a recess 40*a* by half etching a part of an opposite face, and is punched to make an ink introduction port 42 for receiving ink supply from the outside. The thin wall 41 is adapted to absorb pressure toward the opposite side to the nozzle openings 11 occurring when ink drops are jetted; it prevents unnecessary positive or negative pressure from being applied to another pressure generating chamber 12 via the common ink chamber 31. In the embodiment, considering the rigidity required at the connection time of the ink introduction port 42 and an external ink supplier, etc., the ink chamber side plate 40 is 0.2 mm thick and a part thereof is made the thin wall 41 of 0.02 mm thick. However, to skip formation of the thin wall 41 by half etching, the ink chamber side plate 40 may be made 0.02 mm thick from the beginning.

On the other hand, an insulation film 55, for example, 0.1–2 μm thick is formed on the elastic film 50 on the opposite side to the opening face of the flow passage formation substrate 10, and further a lower electrode film 60, for example, about 0.2–0.5 μm thick, a piezoelectric film 70, for example, about 1 μm thick, and an upper electrode film 80, for example, about 0.1 μm thick are deposited on the insulation film 55 by a process described later, making up a piezoelectric element 300. This piezoelectric element 300 refers to the portion containing the lower electrode film 60, the piezoelectric film 70, and the upper electrode film 80. Generally, one electrode of the piezoelectric element 300 is used as a common electrode and the other electrode and the piezoelectric film 70 are patterned so as to correspond to each pressure generating chamber 12. A portion made up of the patterned electrode and the piezoelectric film 70 where piezoelectric distortion occurs as voltage is applied to both electrodes is referred to as an active part 320 of the piezoelectric element 300. In the embodiment, the lower electrode film 60 is used as the common electrode of the piezoelectric element 300 and the upper electrode film 80 is used as a discrete electrode of the piezoelectric element 300, but the lower electrode film 60 may be used as a discrete electrode and the upper electrode film 80 may be used as the common electrode for convenience of a drive circuit and wiring. In any case, the piezoelectric active part is formed for each pressure generating chamber 12. Here, the piezoelectric element 300 and the elastic film displaced by drive of the piezoelectric element 300 are collectively called a piezoelectric actuator. In the embodiment, as described later, the lower electrode film 60 is patterned, thus the elastic film 50 and the insulation film 55 act as a diaphragm.

A process of forming the piezoelectric films 70, etc., on the flow passage formation substrate 10 made of a silicon monocrystalline substrate will be discussed with reference to FIG. 4.

Figure 4A:
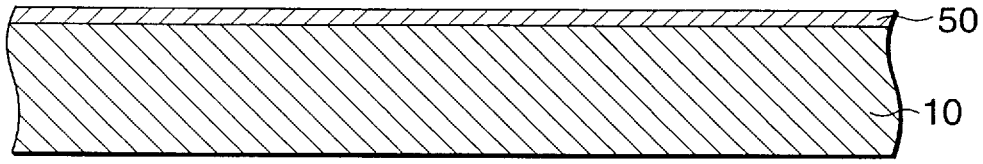
FIGS. 4A to 4E are drawings to show a thin film manufacturing process in the first embodiment of the present invention.

As shown in FIG. 4A, first a wafer of a silicon monocrystalline substrate of which the flow passage formation substrate 10 will be made is thermally oxidized in a diffusion furnace at about 1100° C. to form the elastic film 50 made of silicon dioxide.

Figure 4B:
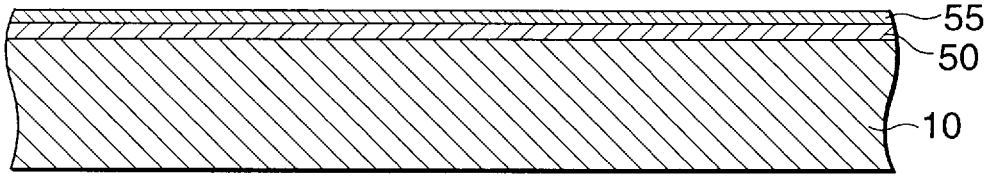

Next, as shown in FIG. 4B, the insulation film 55 is formed on the elastic film 50. Preferably, the insulation film 55 is an intimate-contact insulation film made of a material having a good adhesion with the piezoelectric film 70; for example, it is formed of oxide or nitride of at least one element selected from among the elements of the piezoelectric film 70. In the embodiment, a zirconium layer is formed on the elastic film 50, then thermal oxidation is executed in a diffusion furnace at about 500° C.–1200° C., for example, to form the insulation film 55 made of zirconium oxide.

Figure 4C:
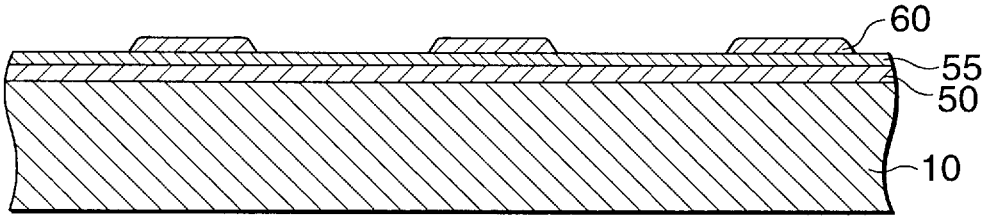

Next, as shown in FIG. 4C, the lower electrode film 60 is formed by sputtering and is patterned in the areas corresponding to the pressure generating chambers 12 so that at least ends on both sides of each lower electrode film in the width direction thereof are positioned in the area facing the corresponding pressure generating chamber 12. Pt, etc., is preferred as a material of the lower electrode film 60, because the piezoelectric film 70 (described later) formed by a sputtering method or a sol-gel method needs to be baked and crystallized at a temperature of about 600° C.–1000° C. in air or an oxygen atmosphere after film formation. That is, the material of the lower electrode film 60 must be able to hold electrical conductivity in such a high-temperature, oxygen atmosphere. Particularly if PZT is used as the piezoelectric film 70, it is desired that change in electrical conductivity caused by diffusion of PbO is less; Pt is preferred for the reasons.

Figure 4D:
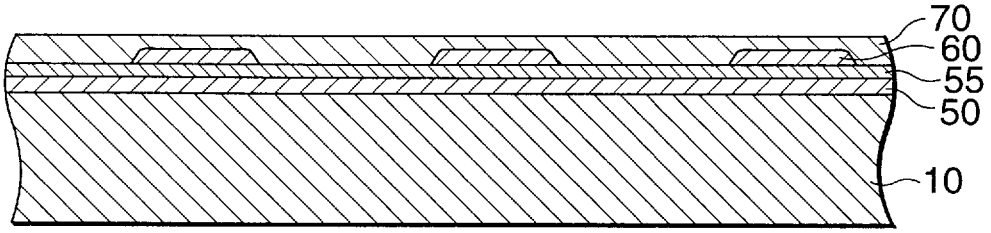

Next, as shown in FIG. 4D, the piezoelectric film 70 is formed. In the embodiment, to form the piezoelectric film 70, a so-called sol-gel method is used wherein so-called sol including metal organic substance dissolved and dispersed in a solvent is applied and dried to gel and further the gel is baked at a high temperature, thereby providing the piezoelectric film 70 made of metal oxide. A lead zirconate titanate (PZT) family material is preferred as a material of the piezoelectric film 70 for use with an ink jet recording head. The formation method of the piezoelectric film 70 is not limited; for example, the piezoelectric film 70 may be formed by the sputtering method. In any way, the piezoelectric film 70 thus formed has crystal oriented unlike bulk piezoelectric substance.

Further, after a precursor film of PZT is formed by the sol-gel method, the sputtering method, or the like, it may be crystal-grown at a low temperature by a high-pressure processing method in an alkaline solution.

In any case, in the piezoelectric film 70 manufactured thereby, crystal direction thereof is preferentially oriented differently from piezoelectric bulk, and the crystal has a columnar structure. Here, "preferential orientation" means a state wherein oriented direction of the crystal is not in disorder but specific crystal faces are almost oriented in a definite direction. And "columnar crystal structure" means a state wherein cylindrical crystals are gathering in a surface direction thereof to form a thin film while central axes thereof are substantially coincident with each other in a thickness direction thereof. Of course, the thin film may be composed with preferentially oriented granular crystals. The thickness of the piezoelectric film manufactured by such thin film technique is 0.5–5 $\mu$m in general.

Figure 4E:
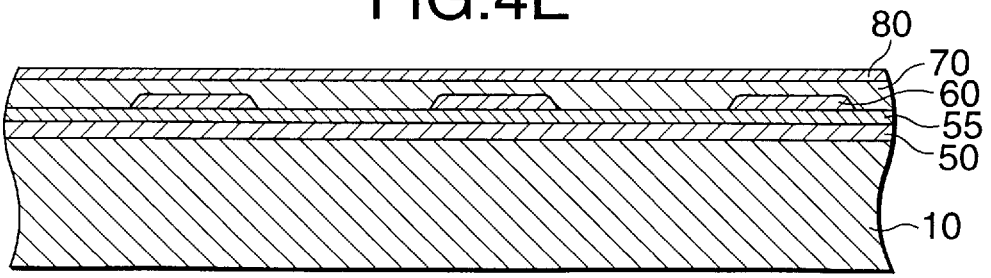

Next, as shown in FIG. 4E, the upper electrode film 80 is formed. The upper electrode film 80 may be made of any material if it has high electrical conductivity; for example, metal of Al, Au, Ni, Pt, etc., conductive oxide, etc., can be used. In the embodiment, the upper electrode film 80 is formed of Pt by the sputtering method.

Figure 5:
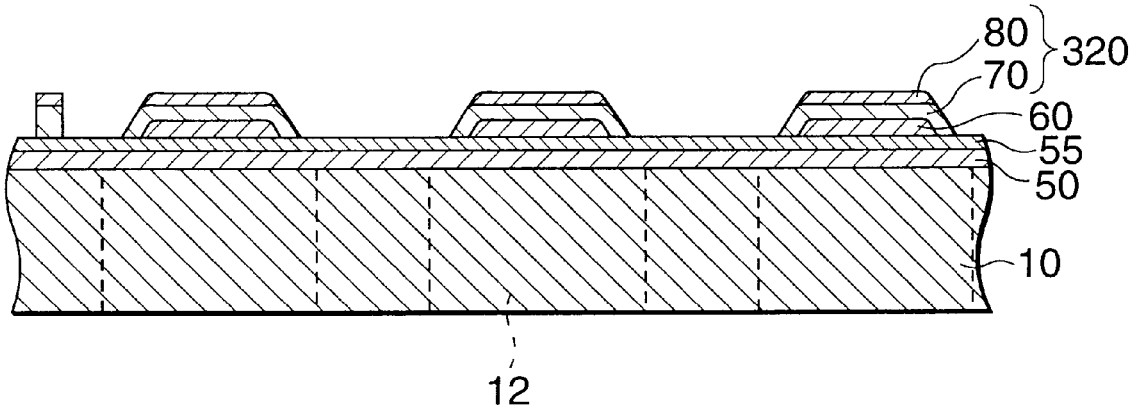
FIG. 5 is a drawing to show the thin film manufacturing process in the first embodiment of the present invention.

Then, as shown in FIG. 5, the piezoelectric film 70 and the upper electrode film 80 are etched in batch for patterning the whole and the piezoelectric active parts 320. In the embodiment, patterning is executed so that the each piezoelectric film 70 covers at least side faces at both ends of the associated lower electrode film 60 in the width direction thereof and that both ends of the piezoelectric film 70 in the width direction thereof are positioned within an area facing the associated pressure generating chamber 12.

Figure 6A:
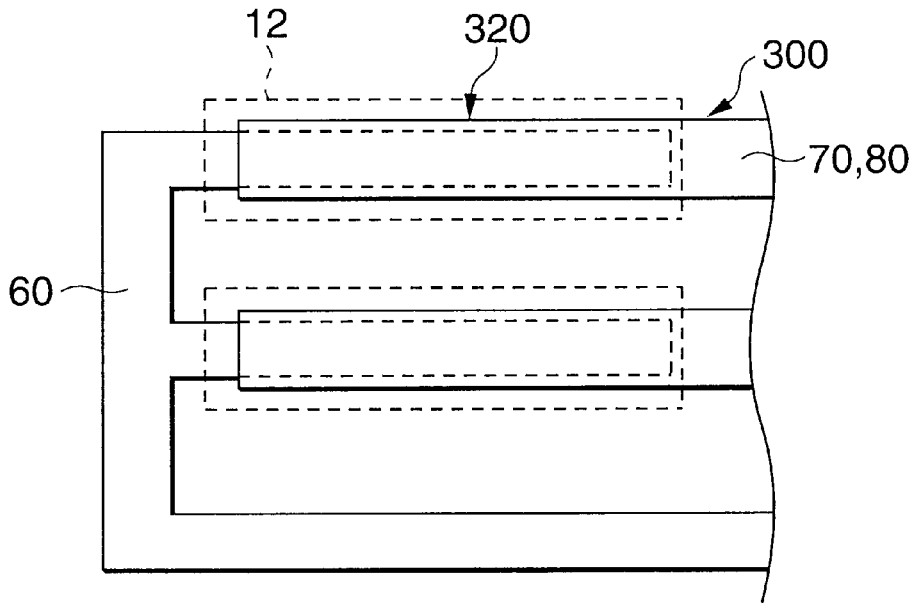
FIGS. 6A and 6B are a plan view and a sectional view of the main part of the ink jet recording head according to the first embodiment of the present invention.
Figure 6B:
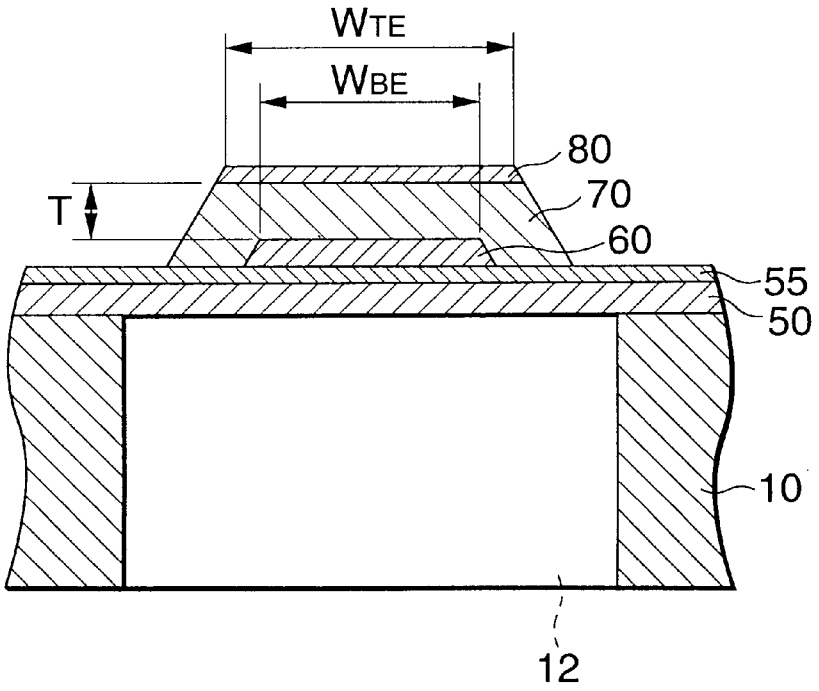

FIGS. 6A and 6B are a plan view and a sectional view to show the main part of the ink jet recording head of the embodiment thus formed.

In the ink jet recording head of the embodiment, as shown in FIG. 6A, each of the piezoelectric element 300 consisting of the lower electrode film 60, the piezoelectric film 70, and the upper electrode film 80 is placed in an area corresponding to the associated pressure generating chamber 12 and each of the active part 320 of the piezoelectric element 300 consisting of the lower electrode film 60 the piezoelectric film 70 and the upper electrode film 80 is formed in an area facing the associated pressure generating chamber 12 and being out of contact with the peripheral wall. In the embodiment, the lower electrode film 60 is patterned, thus the stress relaxation amount of the lower electrode film after the pressure generating chamber is formed is lessened and the initial deflection amount can be decreased as compared with the conventional structure wherein the lower electrode film is not patterned at the piezoelectric film formation time.

Each of the lower electrode film 60 used as one electrode of the piezoelectric element 300 is extended from one end in the longitudinal direction of the associated pressure generating chamber 12 to the top of the peripheral wall thereof and the lower electrode films 60 extended from the respective piezoelectric elements 300 are joined on the top of the peripheral wall as common electrode to the piezoelectric elements 300, and connected to external wiring in the proximity of the end (not shown).

Each of the upper electrode film 80 used as the other electrode of the piezoelectric element 300 is extended together with the associated piezoelectric film 70 from one end in the longitudinal direction of the associated pressure generating chamber 12 (in the embodiment, from the end on the opposite side to the extending direction of the lower electrode film 60) to the top of the peripheral wall, and external wiring (not shown) is connected in the proximity of the end of the upper electrode film 80 so that voltage can be applied for each active part 320 of the piezoelectric element 300.

Thus, in the embodiment, the lower electrode film 60 and the upper electrode film 80 are extended to the top of the peripheral wall in the opposite directions from the end in the longitudinal direction of the pressure generating chamber 12, so that wiring can be drawn without using an inter-layer insulating film or a contact hole, and displacement efficiency and durability can be improved.

As shown in FIG. 6B, the each lower electrode film 60 is formed so that both ends in the width direction are positioned within the area facing the associated pressure generating chamber 12, and both ends of the lower electrode film 60 in the width direction thereof are covered with the associated piezoelectric film 70. The piezoelectric film 70 covering both ends of the lower electrode film 60 in the width direction thereof and the insulation film 55 are formed so that they are adhered with each other.

Thus, both sides of the lower electrode film 60 vibrated during driving are completely covered with the corresponding piezoelectric film 70, so that the strength of the dielectric breakdown thereon is improved and thereby the dielectric breakdown of the piezoelectric film 70 can be prevented. In this embodiment, although the strength of the dielectric breakdown is low because the piezoelectric film 70 is manufactured by the thin-film technique so the thickness thereof as to be thin, the strength of the dielectric breakdown of the piezoelectric film 70 can remarkably improved to surely prevent the electric breakdown thereof by adopting such configuration. Further, since the piezoelectric film 70 and the insulation film 55 are brought completely into intimate contact with each other, the initial deflection amount of the diaphragm is decreased.

The upper electrode film 80 is formed on the piezoelectric film 70 so that the relationship among width $W_{TE}$ of the upper electrode film 80, width $W_{BE}$ of the lower electrode film 60, and thickness T of the piezoelectric film 70 becomes $$(W_{BE}-5T)<W_{TE}<(W_{BE}+5T).$$

Therefore, in the configuration, an electric field produced when a voltage is applied to the part between the upper electrode film 80 and the lower electrode film 60 acts effectively on the piezoelectric film 70 and the active part 320 of the piezoelectric element 300 can be driven effectively.

In the embodiment, both ends of the piezoelectric film 70 in the width direction thereof are positioned in the area facing the pressure generating chamber 12, but the present invention is not limited to this configuration. For example, they may be positioned on the tops of the partitions on both sides in the width direction of the pressure generating chamber 12.

In the embodiment, the insulation film 55 is formed of one layer of only the intimate-contact insulation film, but the present invention is not limited to this configuration. For example, the insulation film 55 may be formed of two or more layers, in which case preferably, the top layer is an intimate-contact insulation film. The intimate-contact insulation film may be formed of multiple layers, needless to say.

In the film formation and anisotropic etching sequence described the above, a large number of chips are formed on one wafer at the same time and after the process terminates, they are separated for each flow passage formation substrate 10 of one chip size as shown in FIG. 1. Each flow passage formation substrate 10 is bonded to the seal plate 20, the common ink chamber formation substrate 30, and the ink chamber side plate 40 in order in one piece to form an ink jet recording head.

With the described ink jet recording head, ink is taken in through the ink introduction port 42 connected to external ink supplier (not shown) and the inside of the recording head from the common ink chamber 31 to the nozzle openings 11 is filled with ink, then a voltage is applied to the part between the lower electrode film 60 and the upper electrode film 80 according to a record signal from an external drive circuit (not shown) for deflection-deforming the elastic film 50, the insulation film 55, the lower electrode film 60, and the piezoelectric film 70, thereby raising pressure in the pressure generating chamber 12 and jetting an ink drop through the nozzle opening 11.

Figure 7:
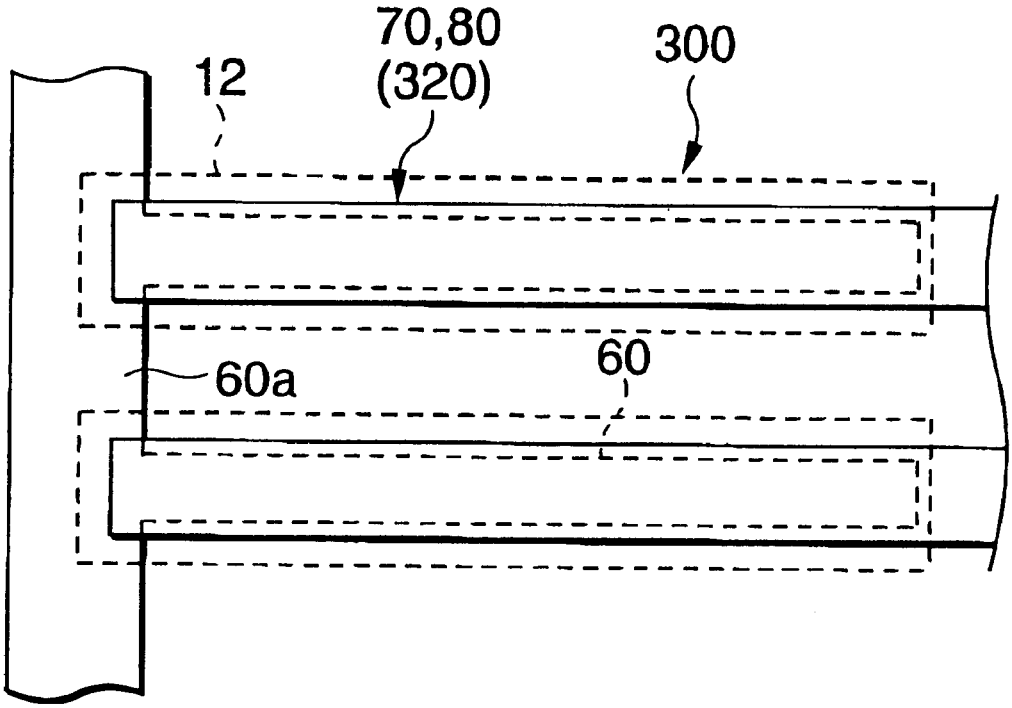
FIG. 7 is a plan view to show a modified example of the ink jet recording head according to the first embodiment of the present invention.

In the embodiment, the lower electrode film 60 is extended from the end in the longitudinal direction of the pressure generating chamber 12 to the top of the peripheral wall, but the present invention is not limited to this configuration. For example, as shown in FIG. 7, a wider portion 60*a* wider than the pressure generating chamber 12 may be provided in that area of the each lower electrode film 60 corresponding to the boundary between the pressure generating chamber 12 and the peripheral wall, and the area may be covered therewith. In the embodiment, the lower electrode films of the adjacent piezoelectric elements are joined by the wider portions 60*a*.

In the embodiment, the lower electrode film 60 is used as the common electrode and the upper electrode film 80 and the lower electrode film 60 are extended from the opposite ends in the longitudinal direction, but the present invention is not limited to this configuration.

Figure 8A:
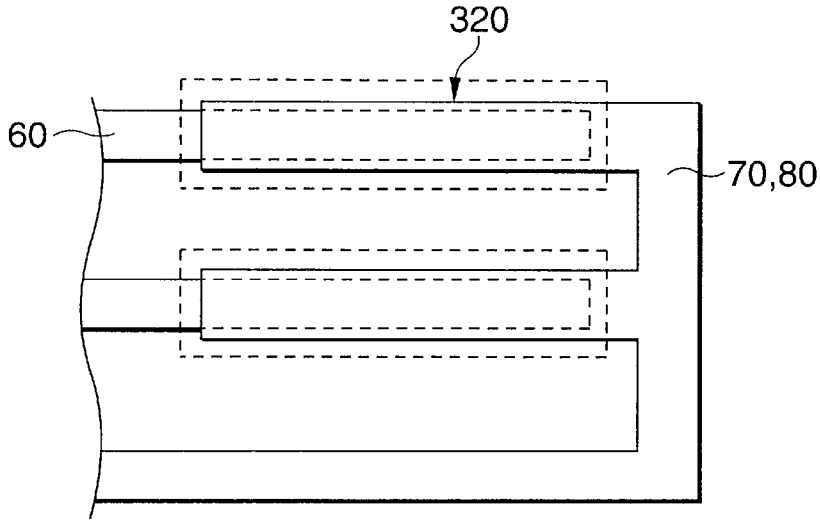
FIGS. 8A to 8C are plan views to show modified examples of the ink jet recording head according to the first embodiment of the present invention.

For example, as shown in FIG. 8A, the upper electrode film 80 may be used as the common electrode and the upper electrode film 80 and the lower electrode film 60 may be extended from the opposite ends in the longitudinal direction to the top of the peripheral wall as in the embodiment.

Figure 8B:
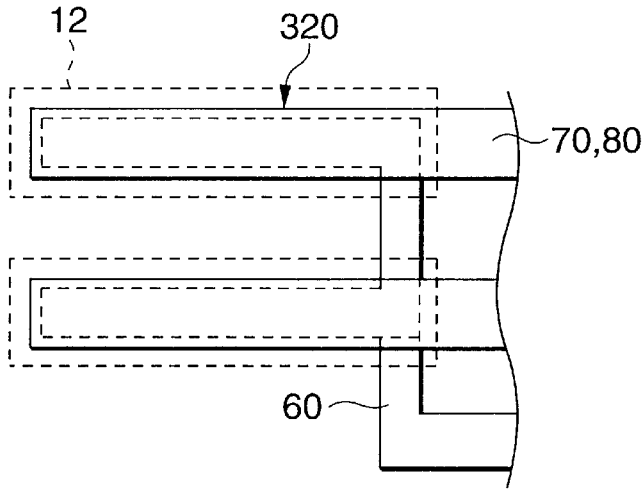

For example, as shown in FIG. 8B, the lower electrode film 60, for example, as the common electrode may be extended from the end in the longitudinal direction of the pressure generating chamber 12 to the top of the outer peripheral wall in the width direction. At this time, preferably, the position at which the lower electrode film 60 crosses the end of the pressure generating chamber 12 is within the dimension of the width thereof from the end in the longitudinal direction of the pressure generating chamber 12 so as not to interface with displacement caused by drive of the active part 320 of the piezoelectric element 300. In such a configuration, a voltage is applied to the part between the upper electrode film 80 and the lower electrode film 60, thereby driving the piezoelectric film 70 in the area sandwiched between the upper electrode film 80 and the lower electrode film 60 in the area facing the pressure generating chamber 12. According to the configurations, similar advantages to those described above can also be provided. In fact, only the active part 320 of the piezoelectric element 300 in the area facing the pressure generating chamber 12 is driven, so that the displacement efficiency can be improved.

Figure 8C:
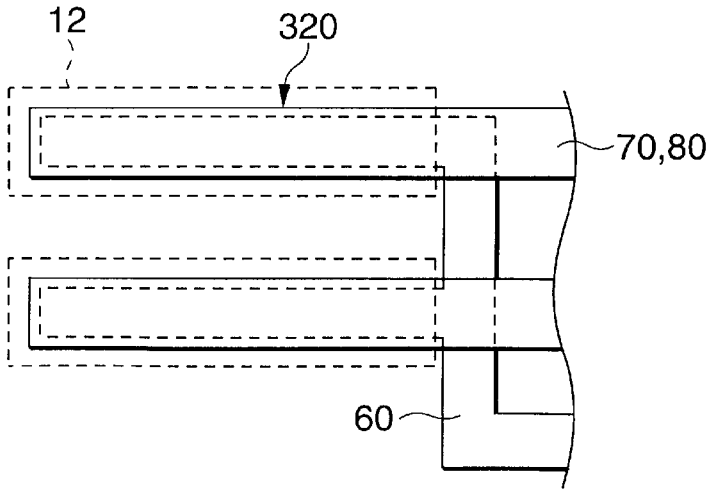

For example, as shown in FIG. 8C, the upper electrode film 80 and the lower electrode film 60 may be extended from the same end in the longitudinal direction of the pressure generating chamber 12 to the top of the peripheral wall. In this case, the lower electrode film 60, the upper electrode film 80, and the piezoelectric film 70 making up the active part 320 of the piezoelectric element 300 in the area facing the pressure generating chamber 12 are extended continuously to the area facing the peripheral wall; except this point, however, similar advantages to those described above can be provided.

Figure 9A:
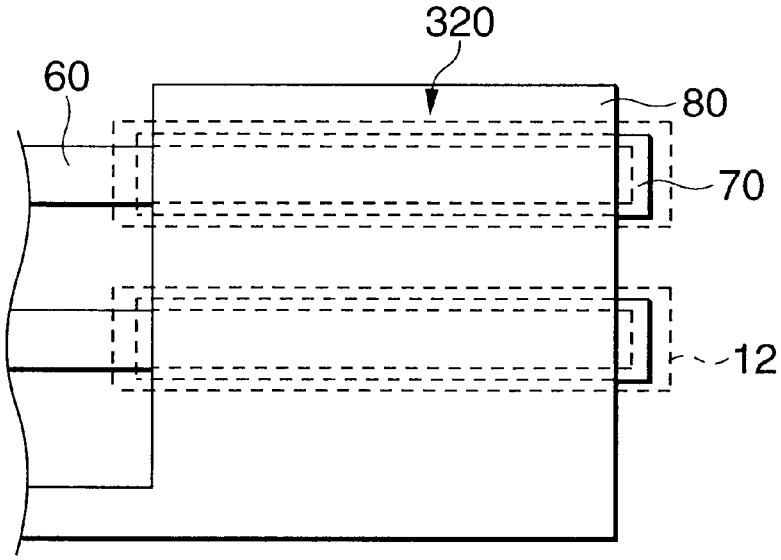
FIGS. 9A and 9B are a plan view and a sectional view to show a modified example of the ink jet recording head according to the first embodiment of the present invention.
Figure 9B:
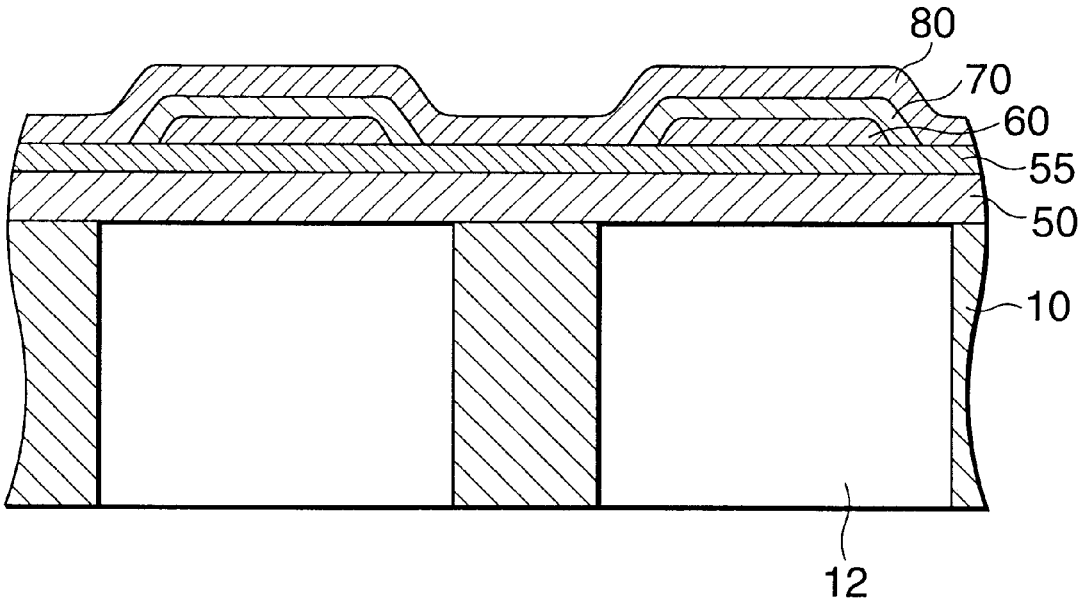

Further, for example, as shown in FIG. 9, the lower electrode film 60 may be used as a discrete electrode and be extended from one end in the longitudinal direction to the top of the peripheral wall of the pressure generating chamber 12 for each active part 320 of the piezoelectric element 300 and the upper electrode film 80 may be formed continuously on the piezoelectric active parts 320 placed side by side in the width direction as the common electrode to the piezoelectric active parts 320. This configuration can be provided by forming the upper electrode film 80 after patterning the piezoelectric film 70, then patterning only the upper electrode film 80. According to the configuration, similar advantages to those described above can also be provided. The upper electrode film 80 is formed continuously on the piezoelectric active parts 320 placed side by side in the width direction, whereby it is also formed in the area facing so-called diaphragm arm parts on both sides in the width direction of the active part 320 of the piezoelectric element 300; the strength of the arm parts is enhanced.

Second Embodiment

Figure 10:
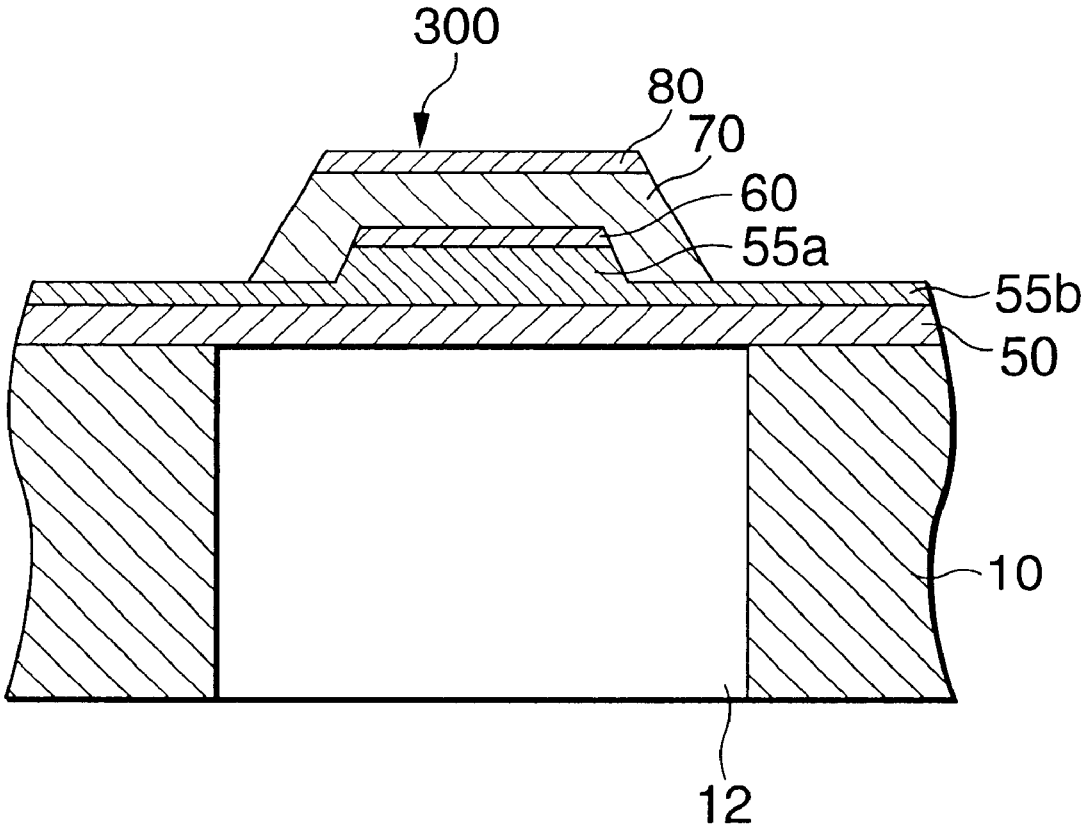
FIG. 10 is a sectional view of the main part of an ink, jet recording head according to a second embodiment of the present invention.

FIG. 10 is a sectional view of the main part of an ink jet recording head according to a second embodiment of the present invention.

As shown in FIG. 10, the second embodiment is the same as the first embodiment except that an insulation thick film portion 55*a* thicker than any other area is formed under the formation area of a lower electrode film 60. According to the configuration, similar advantages to those of the first embodiment can also be provided. Since a piezoelectric film 70 is positioned apart from the neutral axis of displacement caused by drive of a piezoelectric element 300, the displacement efficiency is improved and the exclusion volume can be improved.

A film formation process of the second embodiment will be discussed with reference to FIG. 11.

Figure 11A:
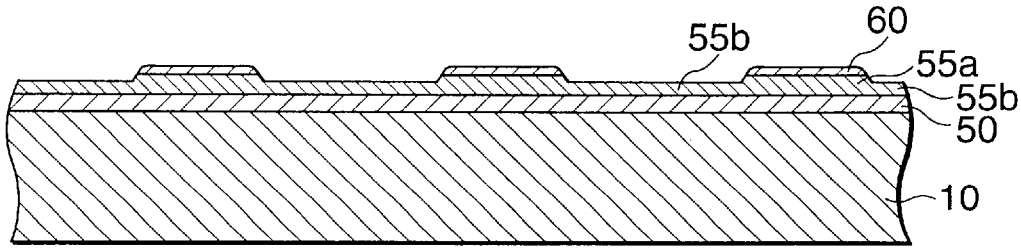
FIGS. 11A to 11D are drawings to show a thin film manufacturing process in the second embodiment of the present invention.

The process of forming an elastic film 50, an insulation film 55, and a lower electrode film 60 on a flow passage formation substrate 10 is similar to that of the first embodiment. After this, as shown in FIG. 11A, the lower electrode film 60 and the insulation film 55 are etched for patterning. At this time, the insulation film 55 is etched to an intermediate point in the thickness direction (half etched). That is, the area where the lower electrode film 60 does not exist is made thin to form an insulation thin film portion 55*b*, whereby an insulation thick film portion 55*a* thicker than any other portion can be formed under the area where the lower electrode film 60 exits.

Figure 11B:
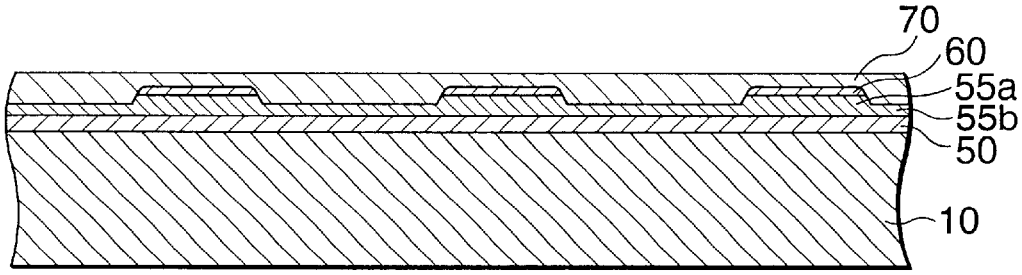
Figure 11C:
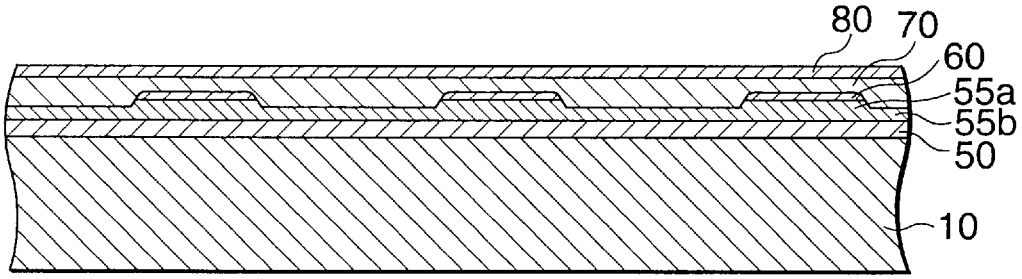

Next, as shown in FIGS. 11B and 11C, a piezoelectric film 70 and an upper electrode film 80 are formed.

Figure 11D:
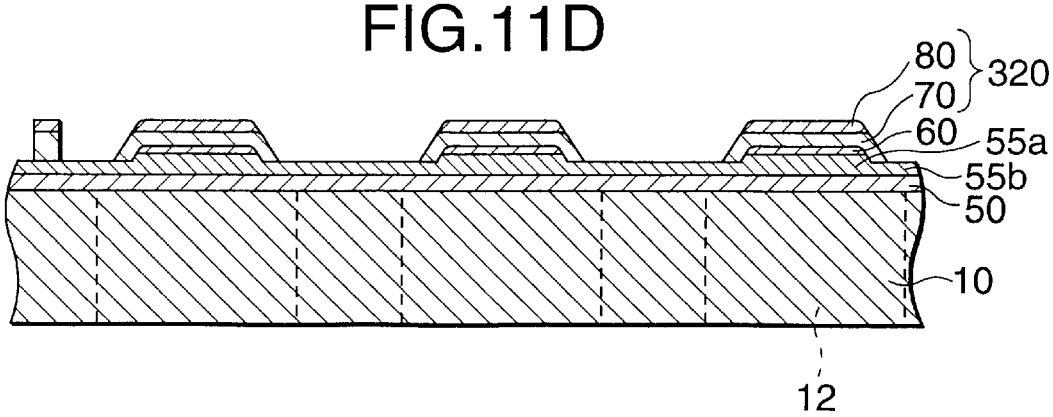

Then, as shown in FIG. 11D, the piezoelectric film 70 and the upper electrode film 80 are etched for patterning the whole and piezoelectric active parts 320. The later steps of the process are similar to those of the first embodiment.

Figure 12:
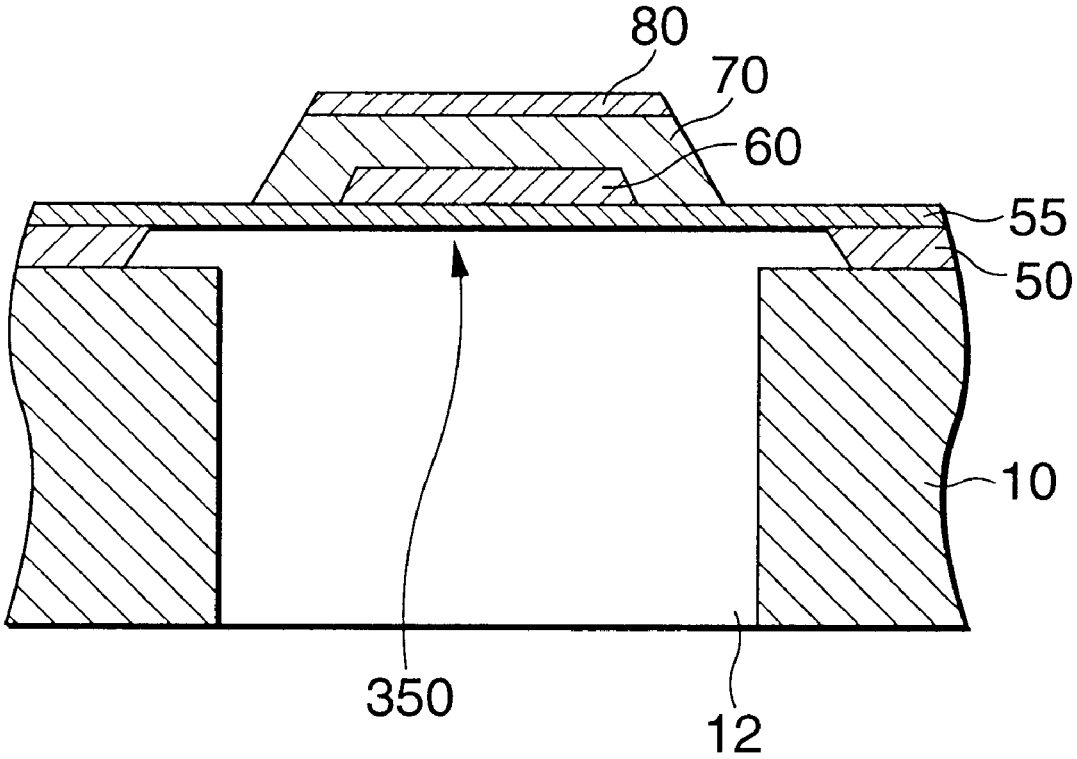
FIG. 12 is a sectional view of the main part of an ink jet recording head according to a third embodiment of the present invention.

FIG. 12 is a sectional view to show the main part of an ink jet recording head according to a third embodiment of the present invention.

As shown in FIG. 12, the third embodiment is the same as the first embodiment except that an elastic film removal part 350 where an elastic film 50 is removed is provided in the area corresponding to a pressure generating chamber 12 and except that an insulation film 55 and a lower electrode film 60 constitute a diaphragm.

The formation method of the elastic film removal parts 350 are not limited to a specific process; for example, the elastic film removal parts 350 may be formed by etching, etc., after the pressure generating chambers 12 are formed.

According to the configuration, similar advantages to those of the first embodiment can also be provided. Since the elastic film removal parts 350 are provided, the arm parts of the diaphragm are formed only of the insulation film 55, so that the diaphragm displacement efficiency caused by drive of an active part 320 of the piezoelectric element 300 is improved and the exclusion volume can be improved.

In the embodiment, the elastic film removal parts 350 are made in the elastic film 50 after the pressure generating chambers 12 are formed. However, the present invention is not limited to this configuration; for example, without providing the elastic film 50 from the beginning, the insulation film 55 may be formed directly on a flow passage formation substrate 10 and the diaphragm may be formed only of the insulation film 55. The area of the insulation film 55 facing the lower electrode film may be made thicker than any other portion as in the second embodiment, needless to say.

Figure 13A:
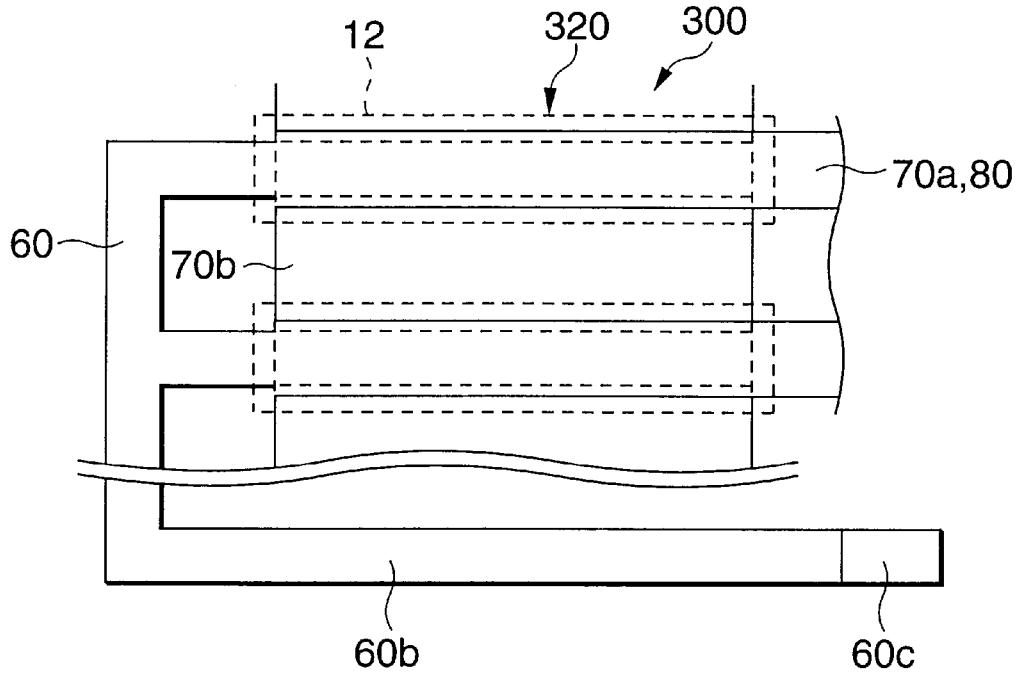
FIGS. 13A and 13B are a plan view and a sectional view of the main part of an ink jet recording head according to a fourth embodiment of the present invention.
Figure 13B:
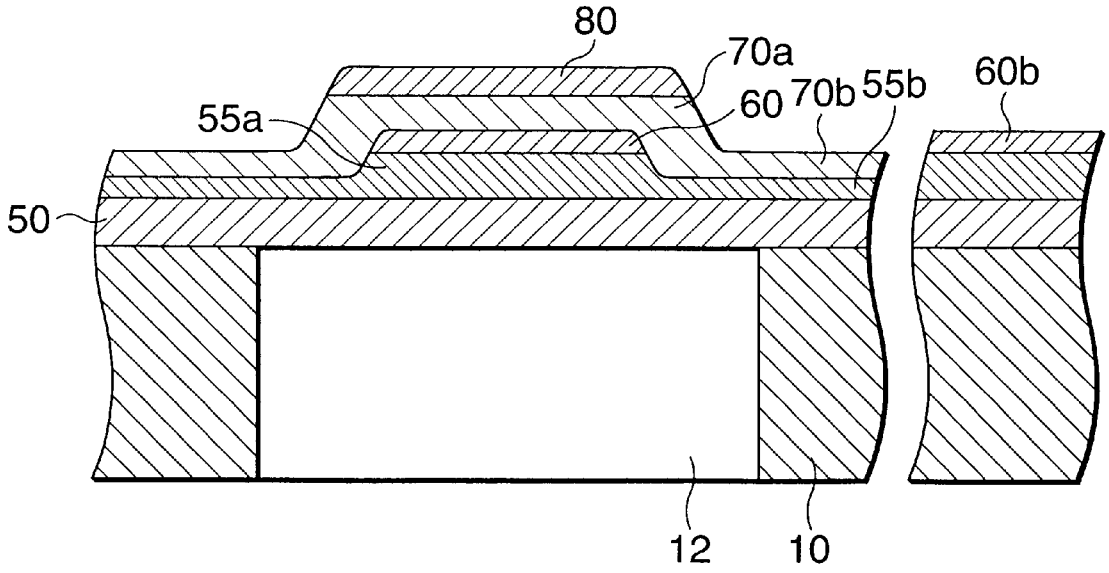

FIGS. 13A and 13B are a plan view and a sectional view to show the main part of an ink jet recording head according to a fourth embodiment of the present invention.

As shown in FIG. 13, the fourth embodiment is the same as the first embodiment except that a piezoelectric film 70 is provided continuously from the area facing a pressure generating chamber 12 to partitions on both sides in the width direction.

That is, in the embodiment, an active part 320 of the piezoelectric element 300 consisting of a lower electrode film 60, a piezoelectric thick film part 70*a* and an upper electrode film 80 are provided in the area facing each pressure generating chamber 12 and on both sides in the width direction of the active part 320 of the piezoelectric element 300, a piezoelectric thin film part 70*b* thinner than the piezoelectric thick film part 70*a* is extended continuously to the outside of the area facing the pressure generating chamber 12.

Figure 14A:
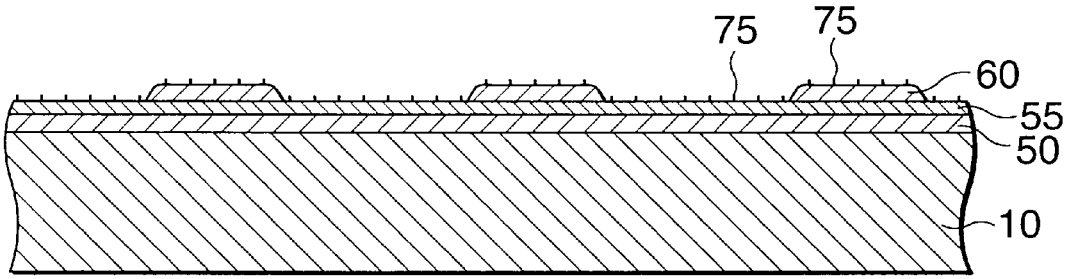
FIGS. 14A to 14C are drawings to show a thin film manufacturing process in the fourth embodiment of the present invention.
Figure 14B:
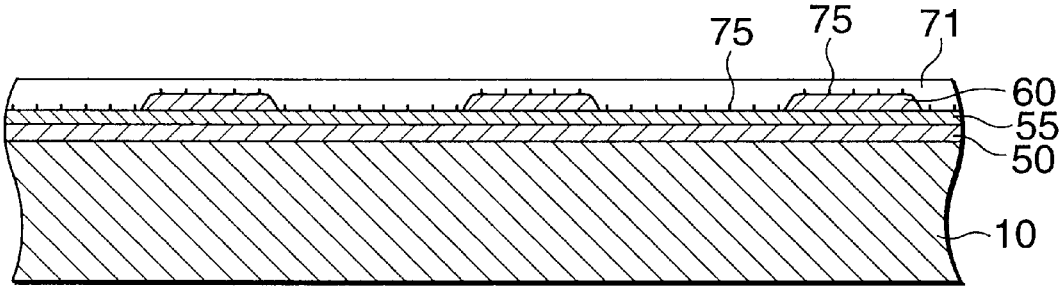
Figure 14C:
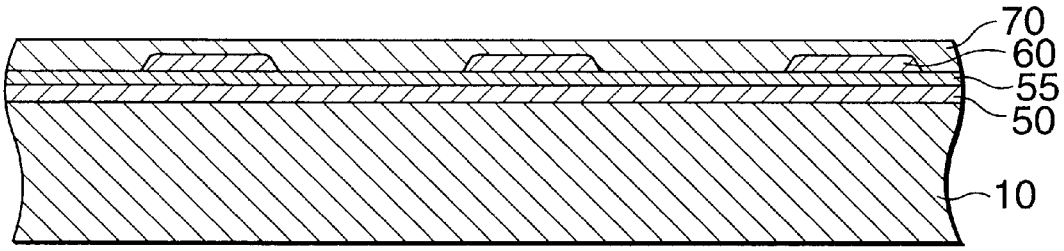

According to the configuration, both sides of the lower electrode film 60 vibrated during driving are completely covered with the piezoelectric film 70, so that strength of the dielectric breakdown is improved remarkably. Since the piezoelectric film 70*b* and the insulation film 55 are brought completely into intimate contact with each other, the initial deflection amount of the diaphragm is decreased. To form the piezoelectric film 70 continuously from the pressure generating chamber 12 to the top of a peripheral wall as in the fourth embodiment, preferably the crystalline structure of the piezoelectric film 70 on the lower electrode film 60 is the same as that on the insulation film 55. Thus, in the embodiment, the piezoelectric film 70 is formed as follows:

In the embodiment, as shown in FIG. 14A, before piezoelectric film 70 is formed, crystal seed 75 made of titanium or titanium oxide is formed like islands on the lower electrode film 60 and the insulation film 55 by the sputtering method, then uncrystallized piezoelectric precursor layer 71 is formed as shown in FIG. 14B, then baked for crystallization to form the piezoelectric film 70 as shown in FIG. 14C.

An art of forming crystal seed and aligning crystal substantially in one orientation to form a piezoelectric film 70 on a lower electrode film 60 of platinum, etc., is known. However, in a special structure wherein piezoelectric film 70 is formed after lower electrode film 60 is patterned as in the embodiment, even if crystal seed is previously formed on the lower electrode film 60, a different crystal structure results on insulation film 55 and a crack easily occurs. Then, in the embodiment, crystal seed 75 is also formed on the insulation film 55, whereby the crystal structure of the piezoelectric film 70 is made almost the same on the lower electrode film 60 and the insulation film 55, thereby preventing cracks and an abnormal stress from occurring. The crystal seed on the insulation film 55 may be formed at the same time after the lower electrode film 60 is patterned. Alternatively, after crystal seed on the lower electrode film 60 is formed and patterning is executed, crystal seed may be formed separately on the insulation film 55 only. In the embodiment, the crystal seed is formed like islands, but the present invention is not limited to this configuration; for example, the crystal seed may be formed like a film.

In the embodiment, as in the above-described embodiment, the lower electrode film 60 used as one electrode of the active part 320 of the piezoelectric element 300 is extended from one end in the longitudinal direction to the top of the peripheral wall of the pressure generating chamber 12 and the lower electrode film 60 extended from each active part 320 of the piezoelectric element 300 is joined on the top of the peripheral wall to form a common electrode to the respective piezoelectric active parts 320, which is connected to external wiring (not shown) in an installation part 60*c* in the proximity of the end of a common part 60*b*.

Since the piezoelectric film is formed using the sol-gel method in the embodiment, the difference in level on the surface of the piezoelectric film 70 before etching is formed small and the piezoelectric film 70 in the area which becomes the piezoelectric thin film part 70*b* after etching becomes comparatively thick. Therefore, if an attempt is made to pattern the piezoelectric film 70 in the area facing the pressure generating chamber 12, the common portion must be exposed in a separate step; however, the piezoelectric thin film part 70*b* is formed, whereby the installation part 60*c* in the common portion can also be exposed at the same time.

Figure 15A:
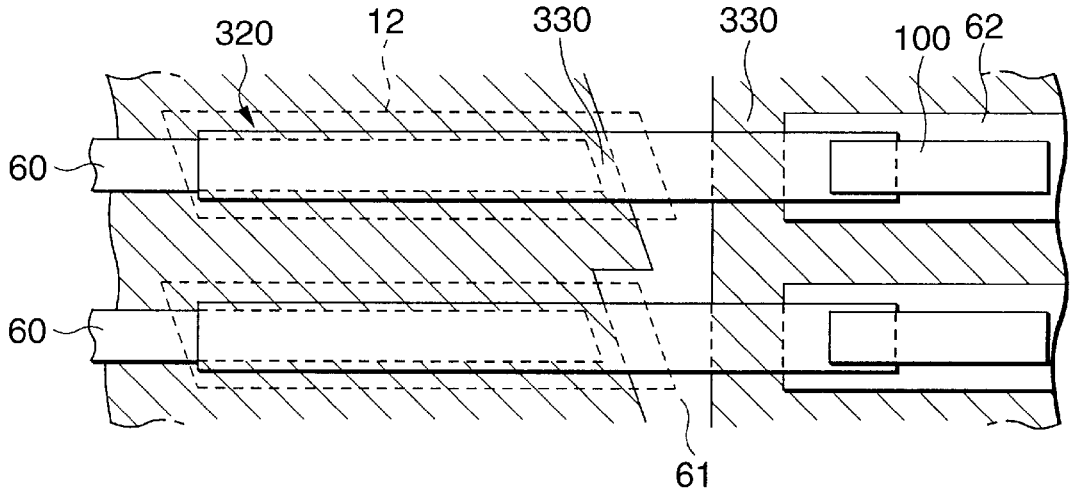
FIGS. 15A and 15B are a plan view and a sectional view of the main part of an ink jet recording head according to a fifth embodiment of the present invention.
Figure 15B:
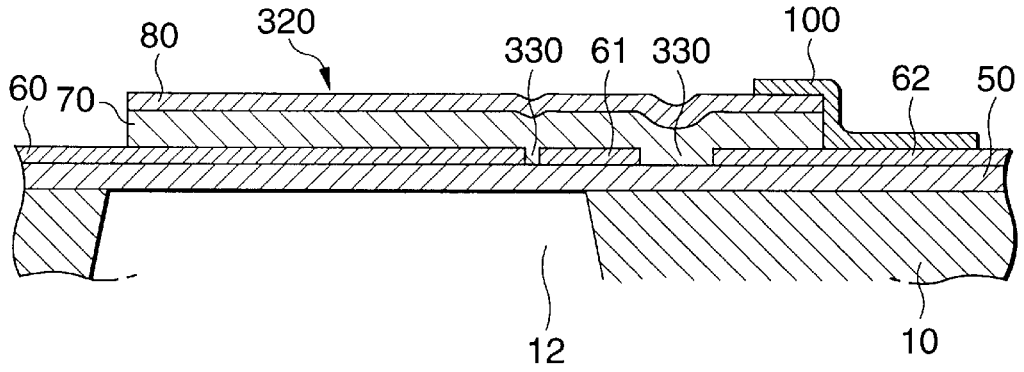

FIGS. 15A and 15B are a plan view and a sectional view of the main part of an ink jet recording head according to a fifth embodiment of the present invention.

As shown in FIG. 15, the fifth embodiment is an example wherein a discontinuous lower electrode film 61 discontinuous with a lower electrode film 60 is formed below a piezoelectric film 70 in the area facing the boundary between one end and the peripheral wall of a pressure generating chamber 12. That is, in the embodiment, in the proximity of the end of the side of the pressure generating chamber 12 where the piezoelectric film 70 and an upper electrode film 80 are extended, a lower electrode film removal part 330 where the lower electrode film 60 is removed is provided, for example, like a narrow groove in the direction in which the pressure generating chambers 12 are placed side by side along the form thereof. The lower electrode film in the boundary between the end and the peripheral wall of each pressure generating chamber 12 becomes the discontinuous lower electrode film 61 discontinuous with the lower electrode film 60 of an active part 320 of the piezoelectric element 300.

In the embodiment, on the top of a peripheral wall on the outside of the discontinuous lower electrode film 61, each wiring lower electrode film 62 used as wiring of each active part 320 of the piezoelectric element 300 is provided by patterning the lower electrode film 60 separately for each active part 320 of the piezoelectric element 300. The piezoelectric film 70 and the upper electrode film 80 are extended onto the wiring lower electrode film 62 via the top of the discontinuous lower electrode film 61, and they are connected by a lead electrode 100. In the embodiment, the lower electrode film 60 is formed directly on an elastic film 50 without providing an insulation film 55 on the elastic film 50.

The width of the lower electrode film removal part 330 separating the lower electrode film 60 and the discontinuous lower electrode film 61 needs to be a width at least capable of holding the insulating strength between the lower electrode film 60 and the discontinuous lower electrode film 61; however, preferably the lower electrode film removal part 330 is made narrow as much as possible for holding the rigidity of a diaphragm.

In the configuration, the discontinuous lower electrode film 61 becomes a floating electrode not electrically connected to any other parts, the piezoelectric film 70 and the upper electrode film 80 disposed on the lower electrode film 60 constitute the active part 320 of the piezoelectric element 300 which becomes a substantial drive part, and the piezoelectric film 70 and the upper electrode film 80 on the discontinuous lower electrode film 61 are not strongly driven.

Therefore, the boundary between the pressure generating chamber 12 and the peripheral wall is not strongly driven if a voltage is applied to the active part 320 of the piezoelectric element 300, thus the rigidity of the diaphragm at the end of the longitudinal direction of the pressure generating chamber 12 is high and destruction of the diaphragm or the piezoelectric film 70 or the like in the portion can be prevented.

Figure 16:
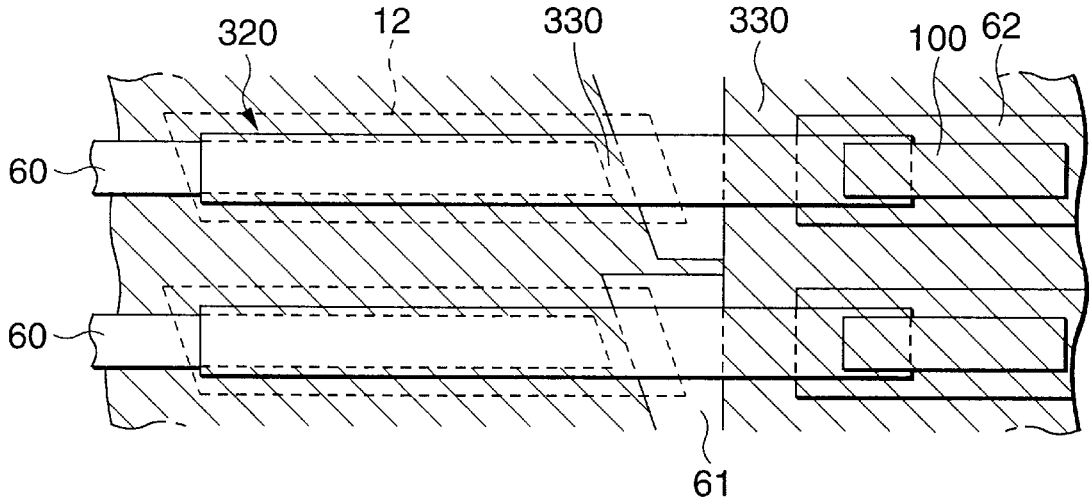
FIG. 16 is a plan view of the main part to show a modified example of the ink jet recording head according to the fifth embodiment of the present invention.

In the embodiment, the discontinuous lower electrode film 61 is formed over the area in the direction in which the pressure generating chambers 12 are placed side by side, but the present invention is not limited to this configuration. For example, as shown in FIG. 16, separate discontinuous lower electrode films 61 may be provided in a one-to-one correspondence with the piezoelectric active parts 320, whereby the piezoelectric film 70 and the upper electrode film 80 on the discontinuous lower electrode film 61 are not driven at all and destruction of the diaphragm or the piezoelectric film 70 or the like can be prevented more reliably.

In the embodiment, the discontinuous lower electrode film 61 is a floating electrode not electrically connected to any other parts, but the present invention is not limited to this configuration. For example, the discontinuous lower electrode film 61 may be connected to an electrode layer via a resistor having a predetermined resistance value so that time constant for charging becomes larger than the drive pulse of the active part 320 of the piezoelectric element 300.

Figure 17A:
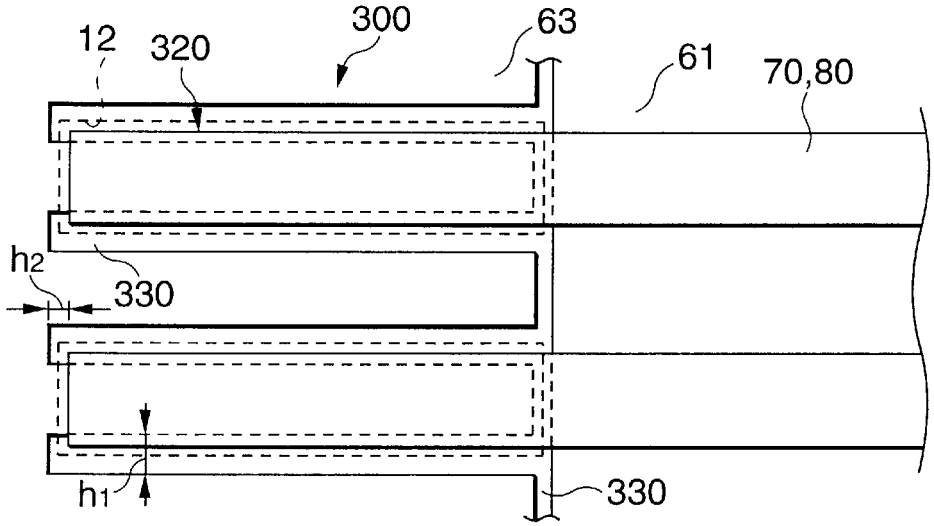
FIGS. 17A to 17C are a plan view and sectional views of the main part of an ink jet recording head according to a sixth embodiment of the present invention.
Figure 17B:
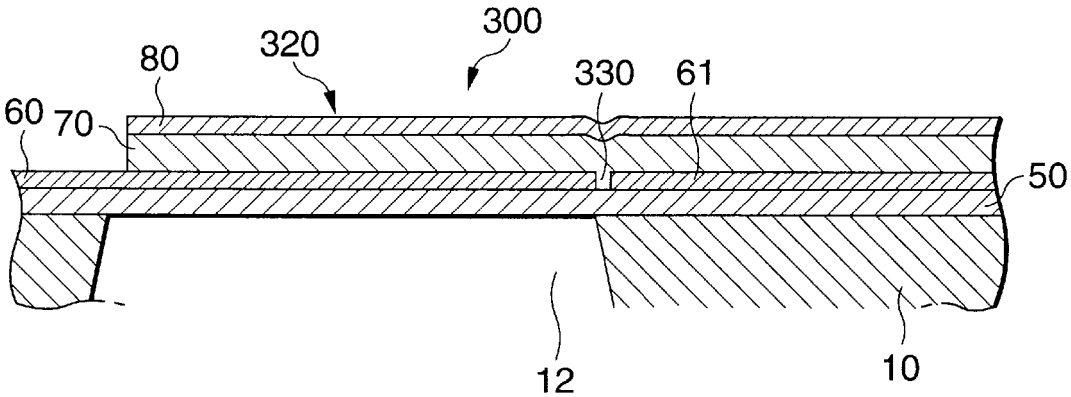
Figure 17C:
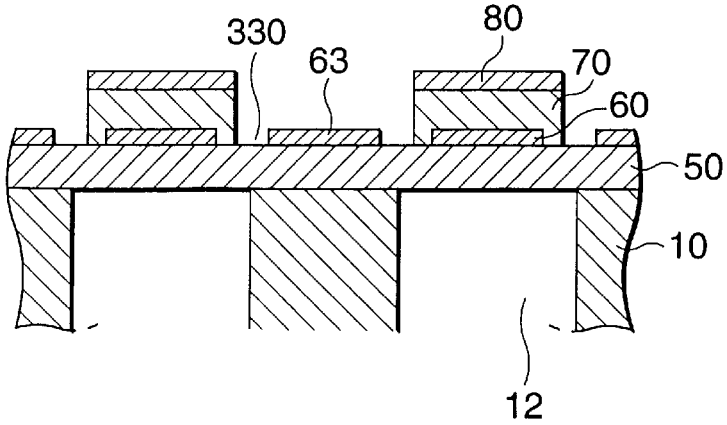

FIGS. 17A to 17C are a plan view and sectional views of the main part of an ink jet recording head according to a sixth embodiment of the present invention.

As shown in FIG. 17, the sixth embodiment is an example wherein a remaining part 63 made of the same layer as a lower electrode film 60 is provided on the top of a partition in the width direction of a pressure generating chamber 12. In the embodiment, the remaining part 63 is provided in the longitudinal direction of the pressure generating chamber 12 continuously with the lower electrode film 60 of an active part 320 of the piezoelectric element 300. That is, lower electrode film removal parts 330 with the lower electrode film 60 removed are provided in the areas facing the boundaries with the partitions on both sides in the width direction of the pressure generating chamber 12, whereby the remaining part 63 is formed in the area facing the partition.

Preferably, spacing h1 between the side at the end in the width direction of the lower electrode film 60 and the side at the end in the width direction of the remaining part 63 and spacing h2 between the side at the end in the longitudinal direction of the piezoelectric film 70 and the part where the lower electrode film 60 extended to the top of the peripheral wall becomes wide are wider than the film thickness of the piezoelectric film 70 and narrower than the width of the lower electrode film 60.

Preferably, the width of the remaining part 63 is 50% or more of the width of the partition; more preferably 80% or more. Further, preferably the lower electrode film 60 or the remaining part 63 is formed in the area of at least 50% or more of the area facing the pressure generating chambers 12 placed side by side and the partitions on both sides in the width direction of the pressure generating chambers 12.

In the embodiment, in the proximity of the end of the side of the pressure generating chamber 12 where the piezoelectric film 70 and the upper electrode film 80 are extended, the lower electrode film 60 is separated by the lower electrode film removal part 330 where the lower electrode film 60 is removed like a narrow groove in the direction in which the pressure generating chambers 12 are placed side by side, and the lower electrode film in the area facing the peripheral wall of each pressure generating chamber 12 becomes a discontinuous lower electrode film 61 discontinuous with the lower electrode film 60 forming a part of the active part 320 of the piezoelectric element 300. The piezoelectric film 70 and the upper electrode film 80 are extended onto the discontinuous lower electrode film 61 and the upper electrode film 80 and external wiring are connected in the proximity of the end (not shown).

Thus, in the embodiment, the remaining part 63 is provided in the area facing the partitions on both sides in the width direction of the pressure generating chamber 12 preferably under the above-described condition, so that the lower electrode film 60 removal area very lessens and if the piezoelectric film 70 is formed on the patterned lower electrode film 60, the film thickness of the piezoelectric film 70 becomes substantially uniform on the whole and the piezoelectric film 70 does not become locally thin.

Since the distance between the side at the end in the longitudinal direction of the piezoelectric film 70 and the part where the lower electrode film 60 extended to the top of the peripheral wall becomes wide is made comparatively narrow, the film thickness of the piezoelectric film 70 becomes uniform even in the proximity of the end in the longitudinal direction of the pressure generating chamber 12. Thus, to use a nonselective etching method such as ion milling to etch the piezoelectric film 70 in the proximity of the end of the side of the pressure generating chamber 12 where the lower electrode film 60 is drawn, the lower electrode film 60 below the piezoelectric film 70 is not removed together and does not become thin. Therefore, the rigidity of the lower electrode film 60 in the proximity of the end of the side of the pressure generating chamber 12 is not degraded and the durability is enhanced. The effect appears remarkably particularly if the piezoelectric film 70 is formed by a spin coat method such as the sol-gel method as described above; in addition, the piezoelectric film 70 may be formed by an MOD method (metal-organic decomposition method), etc., for example.

Figure 18:
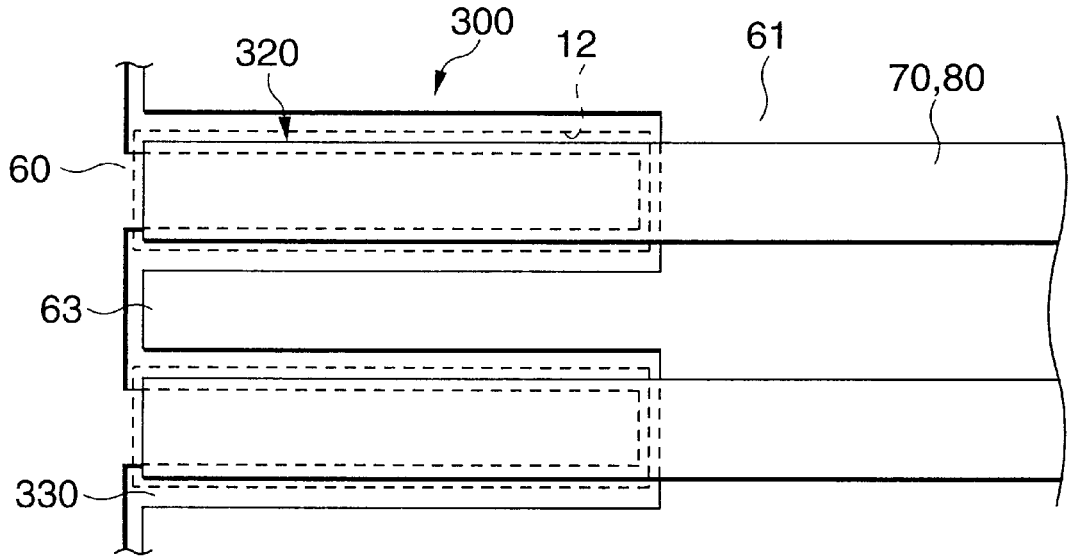
FIG. 18 is a plan view of the main part of an ink jet recording head according to a seventh embodiment of the present invention.

FIG. 18 is a plan view of the main part of an ink jet recording head according to a seventh embodiment of the present invention.

As shown in FIG. 18, the seventh embodiment is the same as the sixth embodiment except that a remaining part 63 provided on the top of a peripheral wall in the width direction of a pressure generating chamber 12 is provided continuously with a discontinuous lower electrode film 61 rather than a lower electrode film 60 forming a part of an active part 320 of the piezoelectric element 300.

According to such a configuration, a piezoelectric film 70 does not become thin and similar advantages to those of the sixth embodiment can be provided.

In the sixth and seventh embodiments, the remaining part 63 is provided continuously with the lower electrode film 60 forming a part of a piezoelectric element 300 or the discontinuous lower electrode film 61, but the present invention is not limited to this configuration. For example, the remaining part 63 may be provided independently.

The remaining part 63 is always left, but the present invention is not limited to this configuration. After the piezoelectric element 300 is formed, the remaining part 63 may be removed. Even in such a configuration, the film thickness of the piezoelectric film 70 is formed substantially uniform, thus similar advantages to those of the above-described embodiment can be provided, of course.

Figure 19A:
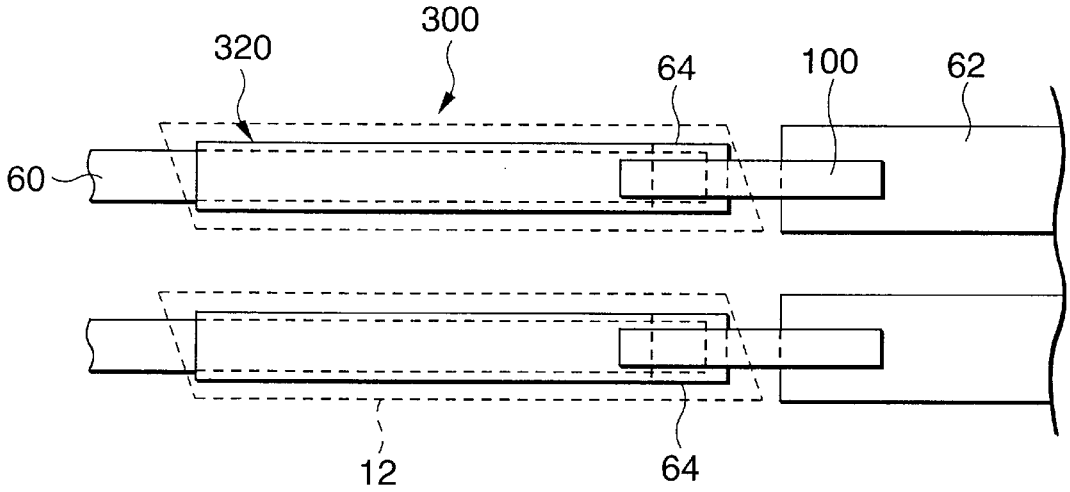
FIGS. 19A and 19B are a plan view and a sectional view of the main part of an ink jet recording head according to an eighth embodiment of the present invention.
Figure 19B:
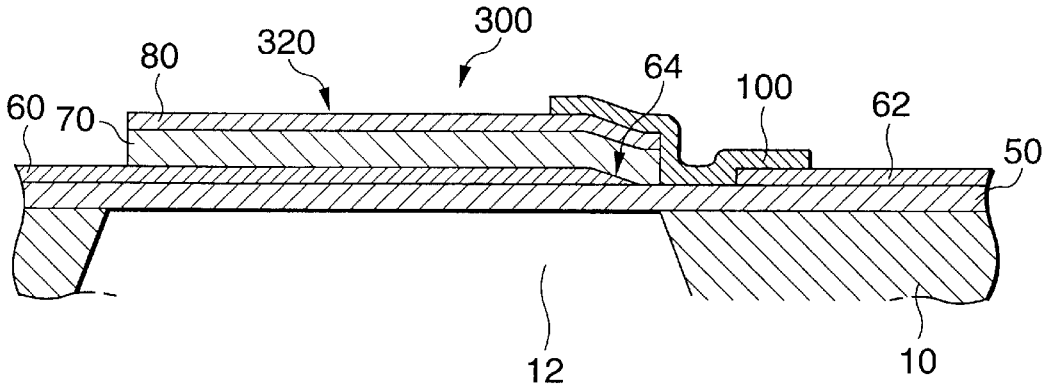

FIGS. 19A and 19B are a plan view and a sectional view of the main part of an ink jet recording head according to an eighth embodiment of the present invention.

As shown in FIG. 19, the eighth embodiment is an example wherein a film tapering part 64 where the film thickness of a lower electrode film 60 is gradually decreased toward the outside of an active part 320 of the piezoelectric element 300 is provided at the end of the lower electrode film 60 forming a part of an active part 320 of the piezoelectric element 300. The form of the film tapering part 64 is not limited to a specific shape; for example, in the embodiment, the film tapering part 64 forms a slope where the film thickness of the lower electrode film 60 is gradually decreased continuously.

In the embodiment, on the top of a peripheral wall on the outside of the film tapering part 64, a wiring lower electrode film 62 used as wiring of each active part 320 of the piezoelectric element 300 is provided by patterning the lower electrode film 60 separately for each active part 320 of the piezoelectric element 300. A piezoelectric film 70 and an upper electrode film 80 are patterned in the area facing a pressure generating chamber 12 and the upper electrode film 80 and the wiring lower electrode film 62 are connected by a lead electrode 100.

In the configuration of the embodiment, the film tapering part 64 where the film thickness is gradually decreased toward the outside of the active part 320 of the piezoelectric element 300 is provided at the end of the lower electrode film 60 as the end of the active part 320 of the piezoelectric element 300, thus if the piezoelectric film 70 is formed on the lower electrode film 60 containing the film tapering part 64, it is formed along the form of the lower electrode film 60 and the whole film thickness becomes substantially uniform. That is, the piezoelectric film 70 at the end of the lower electrode film 60 does not become thin and dielectric breakdown of the piezoelectric film 70 caused by concentration of electric field, etc., in the proximity of the end of the active part 320 of the piezoelectric element 300 can be prevented.

Figure 20A:
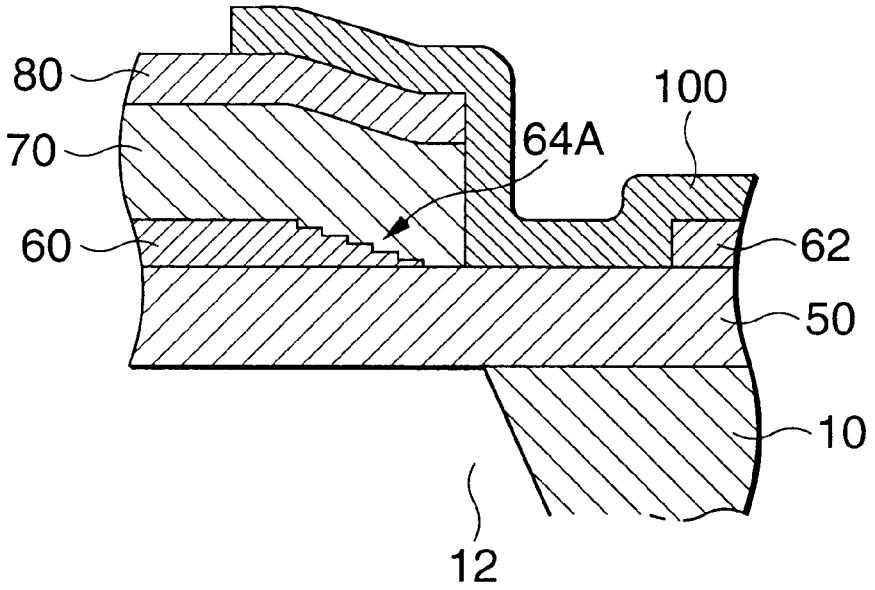
FIGS. 20A and 20B are sectional views of the main parts to show modified examples of the ink jet recording head according to the eighth embodiment of the present invention.

In the embodiment, the film tapering part 64 is made a slope where the film thickness is gradually decreased continuously, but the present invention is not limited to this configuration. For example, as shown in FIG. 20A, a film tapering part 64A may be provided with the film thickness decreased stepwise in cross section. The formation method of the film tapering part 64A is not limited either; for example, a resist is applied more than once and a resist film shaped stepwise substantially the same form as the film tapering part 64A is formed in the area of the lower electrode film 60 where the film tapering part 64A is to be formed, then the lower electrode film 60 is patterned, whereby the film tapering part 64A can be formed.

Figure 20B:
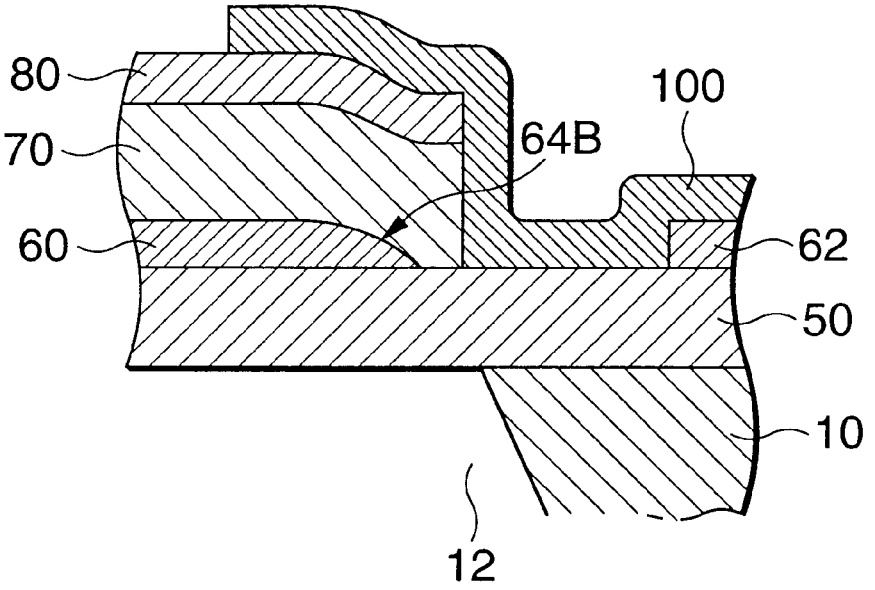

For example, as shown in FIG. 20B, a film tapering part 64B may be provided as a slanting curved surface in cross section. The formation method of the film tapering part 64B is not limited either; for example, the area on the elastic film 50 where the lower electrode film 60 is not formed and the area where the film tapering part 64B is to be formed are masked and the lower electrode film 60 is formed by so-called mask evaporation, whereby the film tapering part 64B is formed. That is, the lower electrode film 60 is also formed in a part of the mask area from a mask gap, providing the film tapering part 64B which is a slanting curved surface in cross section. Of course, as described above, a resist film of substantially the same form as the film tapering part 64B is formed on the lower electrode film 60, then the lower electrode film 60 is patterned, whereby the film tapering part 64B can be formed.

In the embodiment, the piezoelectric film 70 and the upper electrode film 80 are patterned in the area facing the pressure generating chamber 12, but they may be extended onto the wiring lower electrode film 62, of course.

Further, in the embodiment, the upper electrode film 80 and the wiring lower electrode film 62 are connected by the lead electrode 100, but the present invention is not limited to this configuration. For example, the piezoelectric film 70 and the upper electrode film 80 may be extended onto the wiring lower electrode film 62 for connecting the upper electrode film 80 and the wiring lower electrode film 62 directly.

Figure 21A:
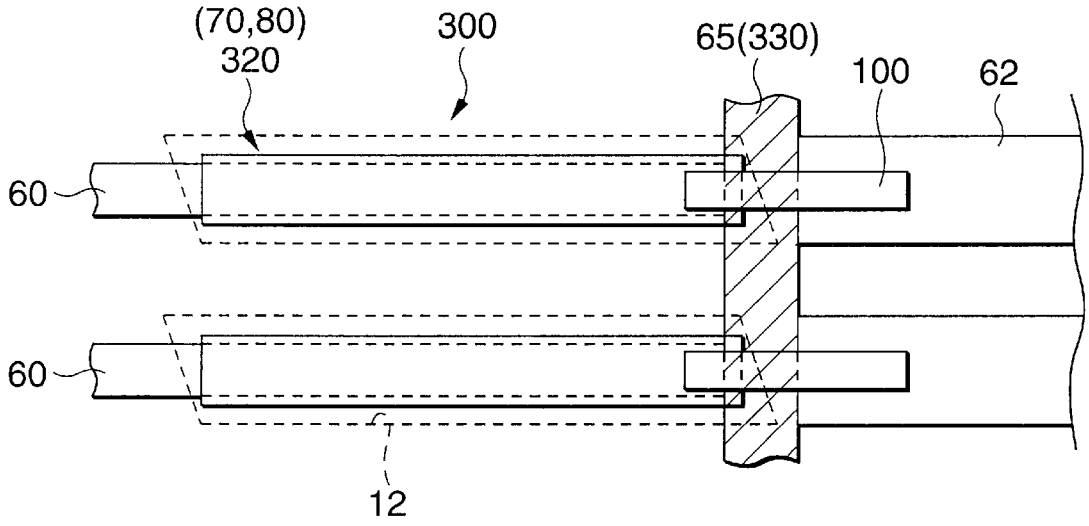
FIGS. 21A and 21B are a plan view and a sectional view of the main part of an ink jet recording head according to a ninth embodiment of the present invention.
Figure 21B:
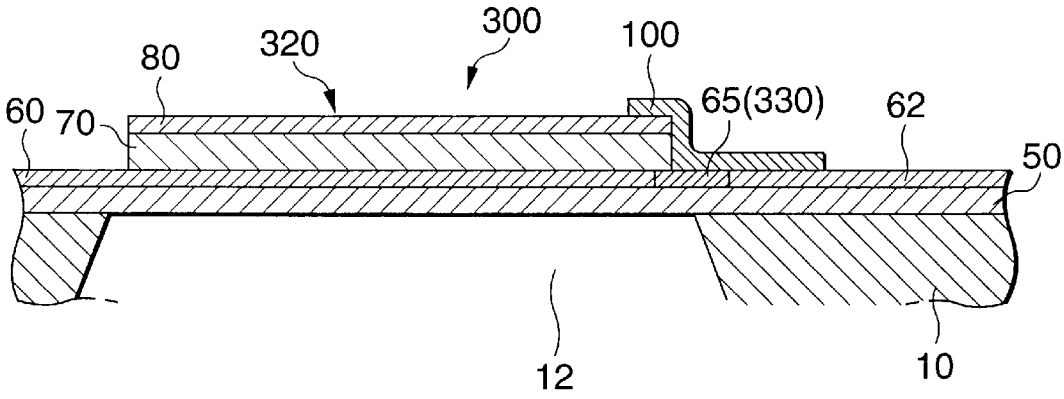

FIGS. 21A and 21B are a plan view and a sectional view of the main part of an ink jet recording head according to a ninth embodiment of the present invention.

The ninth embodiment is an example wherein an insulating film made of an insulating material is provided on the outside in the longitudinal direction of a lower electrode film 60. That is, as shown in FIG. 21, the ninth embodiment is similar to the eighth embodiment except that an active part 320 of the piezoelectric element 300 consisting of a lower electrode film 60, a piezoelectric film 70 and an upper electrode film 80 are formed on an elastic film 50 in the area facing each pressure generating chamber 12 and except that a second insulating film 65 having substantially the same film thickness as the lower electrode film 60 is formed, for example, on the outside of the end of the lower electrode film 60, which is the end of the active part 320 of the piezoelectric element 300. The material of the second insulating film 65 is not limited; for example, it may be an insulating material different from that of an insulating film 55.

In the ninth embodiment, after the lower electrode film 60 is patterned, the second insulating film 65 is formed on a lower electrode film removal part 330 provided on the outside in one end of the lower electrode film 60 in the longitudinal direction thereof, and the piezoelectric film 70 and the upper electrode film 80 are formed and patterned on the second insulating film 65, forming the active part 320 of the piezoelectric element 300, whereby the piezoelectric film 70 does not become thin at the end of the lower electrode film 60, and dielectric breakdown of the piezoelectric film 70 caused by concentration of electric field, etc., in the portion can be prevented. Even in such a configuration, similar advantages to those of the above-described embodiment can be provided, of course.

Figure 22A:
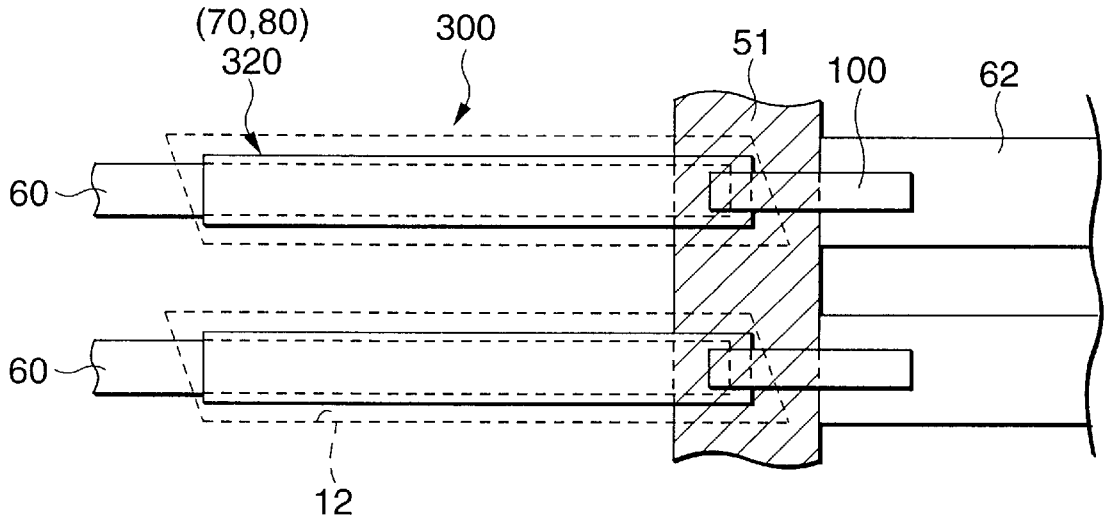
FIGS. 22A and 22B are a plan view and a sectional view of the main part of an ink jet recording head according to a tenth embodiment of the present invention.
Figure 22B:
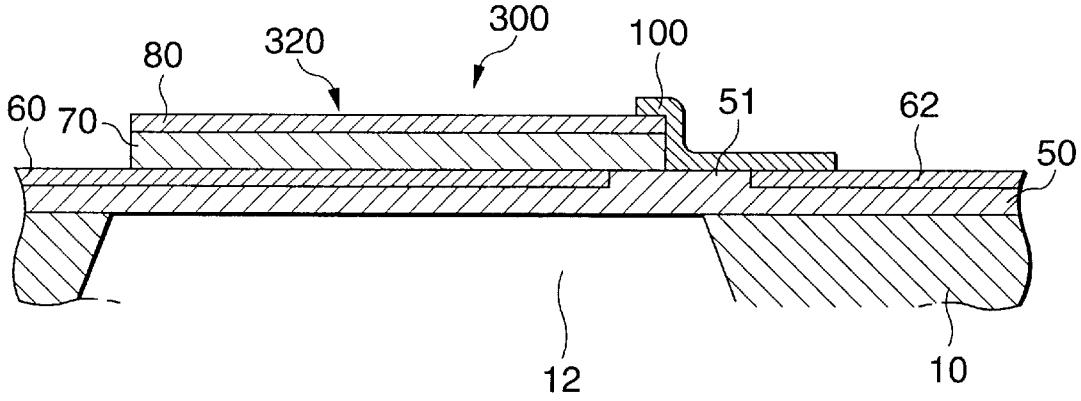

FIGS. 22A and 22B are a plan view and a sectional view of the main part of an ink jet recording head according to a tenth embodiment of the present invention.

As shown in FIG. 22, the tenth embodiment is similar to the ninth embodiment except that a thick film part 51 thicker than any other portion of an elastic film 50 (for example, in the embodiment, placed almost at the same height as a lower electrode film 60) is provided on the outside of an end of the lower electrode film 60, which is an end of an active part 320 of the piezoelectric element 300, in place of a second insulating film 65.

In the tenth embodiment, after an elastic film 50 is patterned to form a thick film part 51 at a predetermined position, a piezoelectric film 70 and an upper electrode film 80 are formed and patterned, thereby forming the active part 320 of the piezoelectric element 300, whereby the piezoelectric film 70 in the area corresponding to the end of the lower electrode film 60 does not become thinner than any other portion, and dielectric breakdown of the piezoelectric film 70 caused by concentration of electric field, etc., in the portion can be prevented. Even in such a configuration, similar advantages to those of the above-described embodiment can be provided, of course.

Figure 23A:
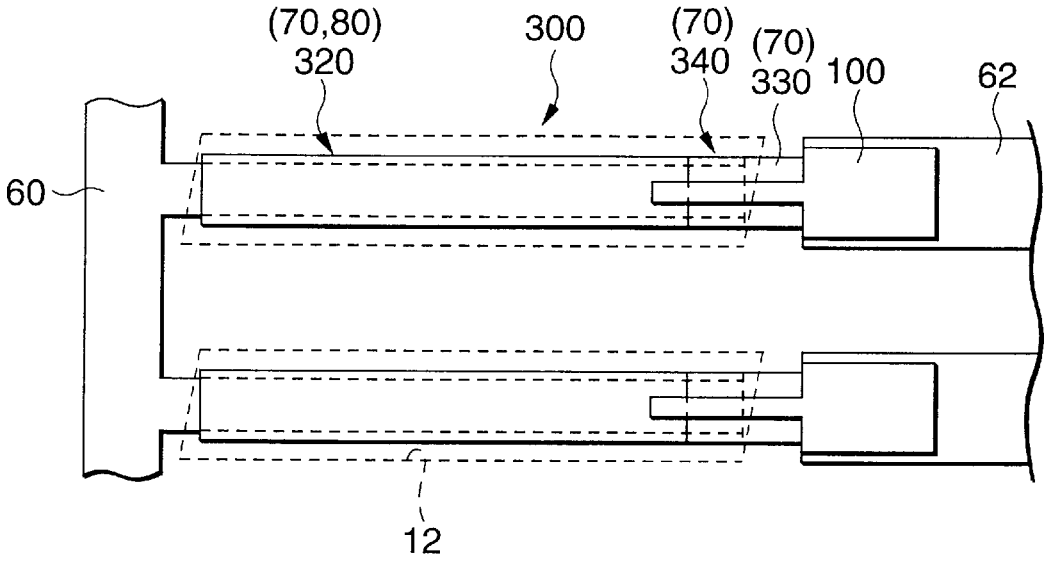
FIGS. 23A and 23B are a plan view and a sectional view of the main part of an ink jet recording head according to an eleventh embodiment of the present invention.
Figure 23B:
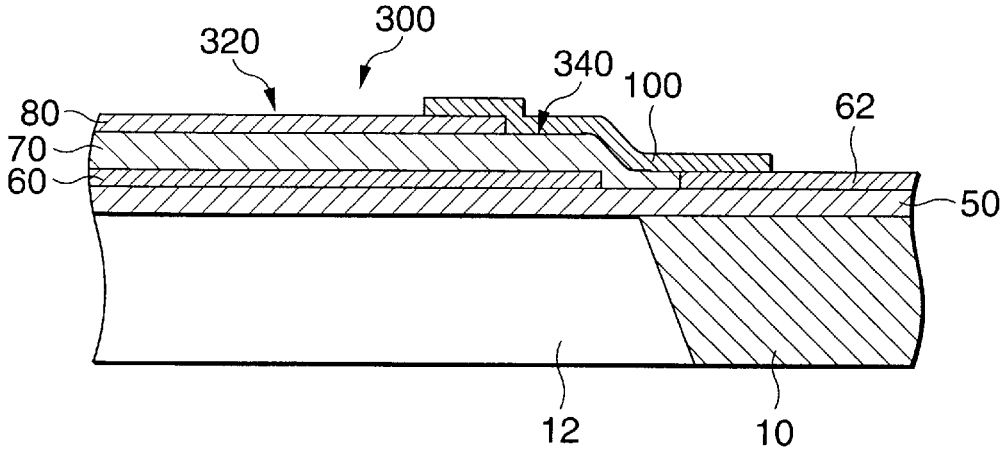

FIGS. 23A and 23B are a plan view and a sectional view of the main part of an ink jet recording head according to an eleventh embodiment of the present invention.

As shown in FIGS. 23A and 23B, the eleventh embodiment is an example wherein an end of an upper electrode film 80 is formed inside from an end of a lower electrode film 60 and becomes an end of an active part 320 of the piezoelectric element 300. For example, in the embodiment, the piezoelectric film 70 is also formed on the lower electrode film 60 projecting to the outside from the end of the upper electrode film 80, but this portion constitutes a piezoelectric inactive part 340 not substantially driven.

As in the eighth embodiment, etc., described above, a wiring lower electrode film 62 is provided on the top of a peripheral wall of a pressure generating chamber 12 and is connected at one end to an external terminal (not shown) and is connected to the upper electrode film 80 of the active part 320 of the piezoelectric element 300 by a lead electrode 100 extended onto the piezoelectric inactive part 340.

In a lower electrode film removal part 330 where the lower electrode film 60 is removed between the wiring lower electrode film 62 and the lower electrode film 60, in the embodiment, the piezoelectric film 70 is not removed and remains and the lower electrode film 60 and the lead electrode 100 are insulated from each other.

Thus, in the embodiment, on the outside of the end of the side of the active part 320 of the piezoelectric element 300 where the lead electrode 100 is drawn, the piezoelectric inactive part 340 is provided continuously, for example, by removing the upper electrode film 80, whereby the distance between the end of the upper electrode film 80, which is the end of the active part 320 of the piezoelectric element 300, and the end of the lower electrode film 60 can be made large. Thus, if a voltage is applied to the active part 320 of the piezoelectric element 300, the electric field strength at the end of the active part 320 of the piezoelectric element 300 does not grow and dielectric breakdown of the piezoelectric film 70, etc., can be prevented. Since the thickness of the piezoelectric film 70 of the active part 320 of the piezoelectric element 300 becomes uniform, the piezoelectric characteristic is improved. Even in such a configuration, similar advantages to those of the above-described embodiment can be provided.

The embodiments of the present invention have been described, but the basic configuration of the ink jet recording head is not limited to the configurations described above.

For example, in the above-described embodiments, the end of the lower electrode film 60 is the end of the active part 320 of the piezoelectric element 300 and the piezoelectric film 70 and the upper electrode film 80 on the lower electrode film 60 are extended to the outside of the end for preventing destruction of the active part 320 of the piezoelectric element 300; at the opposite end, the lower electrode film 60 is drawn to the top of the peripheral wall and the piezoelectric film 70 and the upper electrode film 80 are patterned in the pressure generating chamber 12, thereby forming the end of the active part 320 of the piezoelectric element 300. There is a possibility that peeling, etc., of the piezoelectric film 70 and the upper electrode film 80 may occur at the end. However, for example, the end of the active part 320 of the piezoelectric element 300 may be fixed with an adhesive, etc., or be covered with a discontinuous piezoelectric film discontinuous with the piezoelectric film 70 of the piezoelectric element 300 or the like, whereby it is protected for enhancing durability.

For example, in the above-described embodiments, the structure of the side of one end of the active part 320 of the piezoelectric element 300 is described, but the present invention is not limited to this configuration. Of course, a similar structure may be adopted for the opposite end of the active part 320 of the piezoelectric element 300.

For example, in addition to the above-described seal plate 20, the common ink chamber formation plate 30 may be made of glass ceramic and further the thin wall 41 may be made of glass ceramic as a separate member; the material, structure, etc., can be changed as desired.

In the embodiments, the nozzle openings are made in the end face of the flow passage formation substrate 10, but may be formed projecting in a direction perpendicular to the plane.

Figure 24:
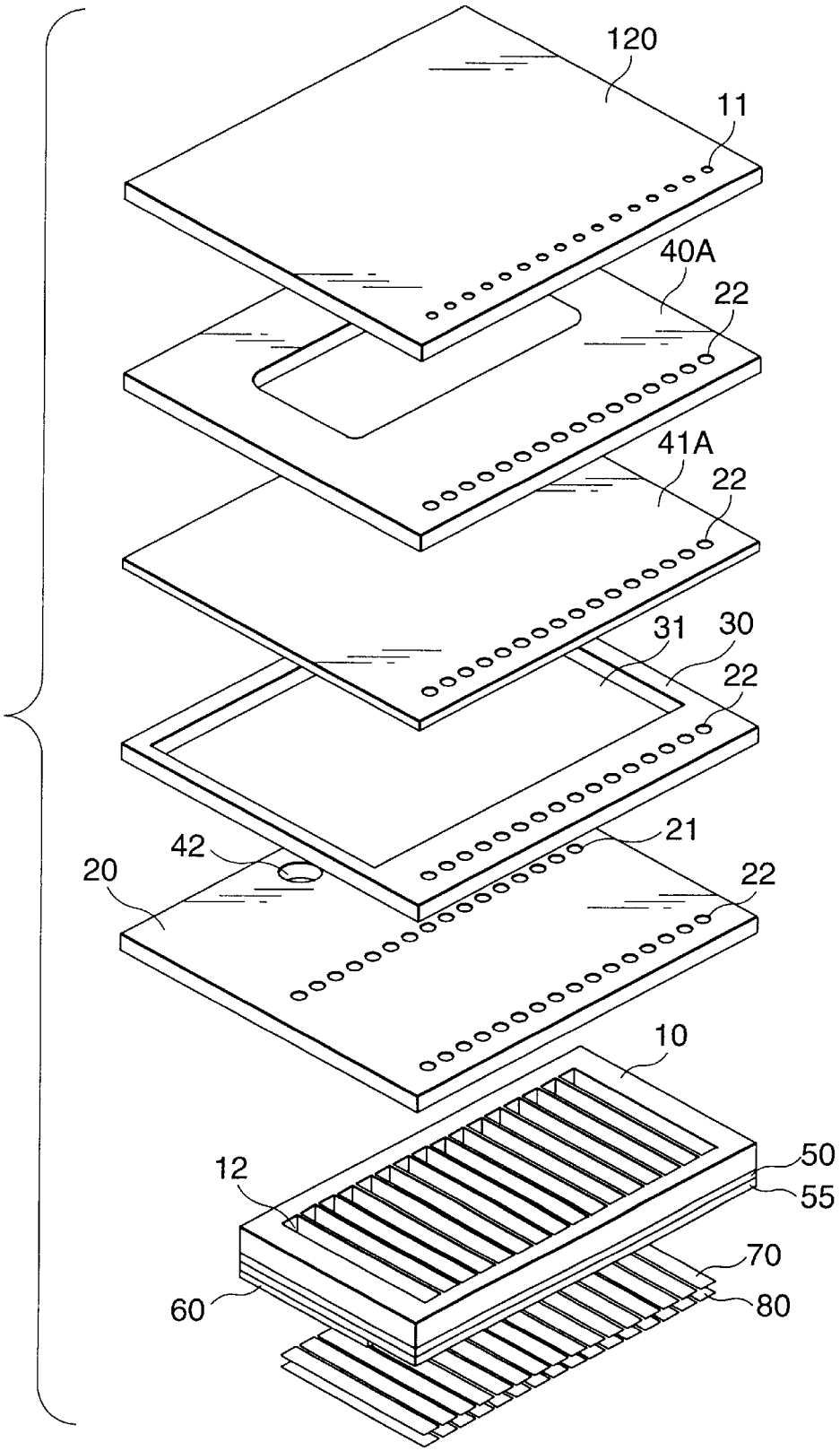
FIG. 24 is an exploded perspective view to show an ink jet recording head according to another embodiment of the present invention.
Figure 25:
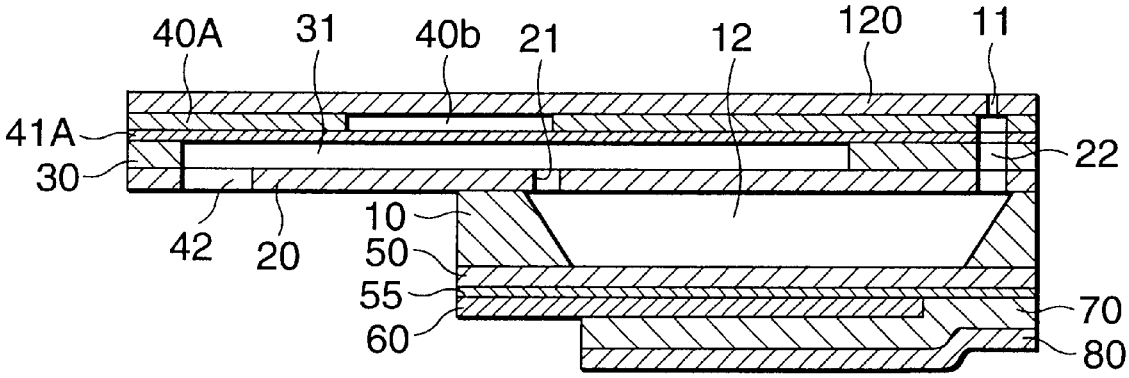
FIG. 25 is a sectional view to show the ink jet recording head shown in FIG. 24.

FIG. 24 is an exploded perspective view of an embodiment of an ink jet recording head having such a configuration and FIG. 25 is a sectional view to show a flow passage in the ink jet recording head. In the embodiment, nozzle openings 11 are made in a nozzle substrate 120 opposed to piezoelectric vibrator and nozzle communication ports 22 for allowing the nozzle openings 11 and pressure generating chambers 12 to communicate with each other are placed so as to penetrate a seal plate 20, a common ink chamber formation plate 30, a thin plate 41A, and an ink chamber side plate 40A.

The embodiment is basically similar to the above-described embodiments except that the thin plate 41A and ink chamber side plate 40A are separate members and except that an opening 40*b* is made in the ink chamber side plate 40A. Parts identical with those previously described with reference to the accompanying drawings are denoted by the same reference numerals in FIGS. 24 and 25 are will not be discussed again.

Of course, the present invention can also be applied to ink jet recording heads of the type wherein a common ink chamber is formed in a flow passage formation substrate.

Thus, the present invention can be applied to ink jet recording heads of various structures without departing from the spirit and the scope of the present invention.

Figure 26:
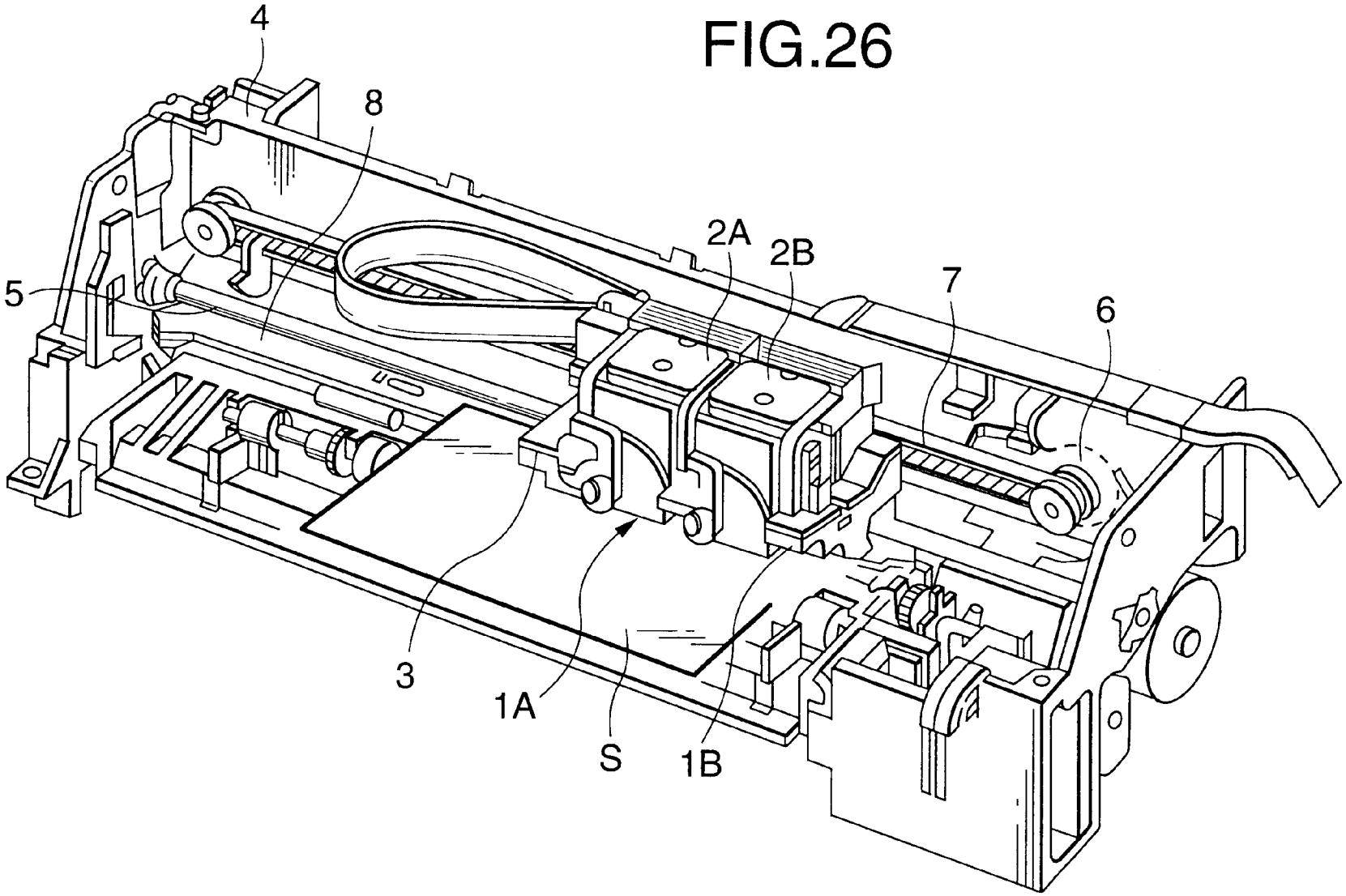
FIG. 26 is a schematic diagram to show an ink jet recording apparatus according to one embodiment of the present invention.

Each of the ink jet recording heads of the embodiments forms a part of a recording head unit comprising an ink flow passage communicating with an ink cartridge, etc., and is installed in an ink jet recording apparatus. FIG. 26 is a schematic diagram to show an example of the ink jet recording apparatus.

As shown in FIG. 26, cartridges 2A and 2B forming a ink supply member are detachably placed in recording head units 1A and 1B each having an ink jet recording head, and a carriage 3 on which the recording head units 1A and 1B are mounted is placed so as to be axially movable on a carriage shaft 5 attached to a recorder main body 4. The recording head units 1A and 1B jet a black ink composite and a color ink composite respectively, for example.

The driving force of a drive motor 6 is transmitted to the carriage 3 via a plurality of gears and a timing belt (not shown), whereby the carriage 3 on which the recording head units 1A and 1B are mounted is moved along the carriage shaft 5. On the other hand, the recorder main body 4 is provided with a platen 8 along the carriage shaft 5 and a recording sheet S of a recording medium such as paper fed by a paper feed roller, etc., (not shown) is wrapped around the platen 8 and is transported.

Thus, in the embodiments of the present invention, the lower electrode film is patterned in the areas facing the pressure generating chambers and both ends in the width direction thereof are covered with the piezoelectric layer, so that the strength of the dielectric breakdown on a sidewall is improved. Especially, in the piezoelectric film manufactured by the thin-film technique, it is easily occurred the dielectric breakdown because such piezoelectric film has thin thickness. However, adopting such a configuration, the electric breakdown of the piezoelectric film can be surely prevented.

Further, since the piezoelectric film and the insulation film are brought into intimate contact with each other, the initial deflection amount of the diaphragm at the time of forming the pressure generating chamber is decreased. Further, the width of the upper electrode film is formed within the predetermined range, thus lowering of the displacement efficiency of the piezoelectric active part by applying a voltage can be prevented. Therefore, the piezoelectric active part of each diaphragm can be driven efficiently.

If the remaining part made of the same layer as the lower electrode film is provided on the tops of the partitions on both sides in the width direction of the pressure generating chamber and the area of the lower electrode film removal part is made small, the piezoelectric film can be formed in a substantially uniform film thickness and degradation of the partial piezoelectric characteristic of the piezoelectric film can be suppressed. Further, since the film thickness of the piezoelectric film is substantially uniform, when the piezoelectric film is patterned at the end of the side of the pressure generating chamber where the lower electrode film is drawn, the lower electrode film does not become thin; destruction of the lower electrode film, etc., can be prevented and the durability is enhanced.

If the second insulating film, thick film part, or the like is provided on the outside of the end of the lower electrode film, which becomes the end of the piezoelectric active part, and the piezoelectric film and the upper electrode film are formed and patterned thereon, the piezoelectric film in the proximity of the end of the lower electrode film does not become thinner than any other portion, and dielectric breakdown of the piezoelectric film caused by concentration of electric field, etc., can be prevented.

Further, wiring can be drawn easily without using an inter-layer insulating film or a contact hole, and the displacement efficiency and durability can be improved.

What is claimed is:

1. An ink jet recording head, comprising:

a pressure generating chamber communicating with a nozzle opening; and a piezoelectric element comprising a lower electrode provided on an area facing the pressure generating chamber via an insulating layer, a piezoelectric layer provided on the lower electrode, and an upper electrode provided on the piezoelectric layer, wherein at least both ends of the lower electrode in a width direction thereof are positioned within the area facing the pressure generating chamber, and the piezoelectric layer covers sides of both ends of the lower electrode in the width direction thereof, wherein the end of the lower electrode is disposed at one end portion in a longitudinal direction of the pressure generating chamber, wherein an end of the upper electrode is disposed inside from the end of the lower electrode in the longitudinal direction of the pressure generating chamber, wherein the piezoelectric layer is extended to the outside of the end of the lower electrode in the longitudinal direction of the pressure generating chamber, and wherein the end of the upper electrode constitutes one end of a active part of the piezoelectric element which is a substantial driving part of the piezoelectric layer.

2. An ink jet recording head comprising:

a pressure generating chamber communicating with a nozzle opening; and a piezoelectric element comprising a lower electrode provided on an area facing the pressure generating chamber via an insulating layer, a piezoelectric layer provided on the lower electrode, and an upper electrode provided on the piezoelectric layer, wherein at least both ends of the lower electrode in a width direction thereof are positioned within the area facing the pressure generating chamber, and the piezoelectric layer covers sides of both ends of the lower electrode in the width direction thereof, wherein the end of the lower electrode is disposed at one end portion in a longitudinal direction of the pressure generating chamber, wherein the piezoelectric layer and the upper electrode are extended to the outside of the end of the lower electrode in the longitudinal direction of the pressure generating chamber, and wherein the end of the lower electrode constitutes one end of a active part of the piezoelectric element which is a substantial drive part of the piezoelectric layer.

3. The ink jet recording head as set forth in claim 2, wherein crystal direction of the piezoelectric layer is preferentially oriented.

4. The ink jet recording head as set forth in claim 3, wherein the piezoelectric layer has a columnar crystal structure.

5. The ink jet recording head as set forth in claim 2, wherein the insulating layer in the area under the area where the lower electrode is formed is thicker than any other area.

6. The ink jet recording head as set forth in claim 2, wherein the top of the insulating layer in a thickness direction thereof is made of an adhesive insulating layer made of a material having a good adhesion with the piezoelectric layer, and wherein the adhesive insulating layer is adhered with the piezoelectric layer covering sides of both ends of the lower electrode in the width direction thereof.

7. The ink jet recording head as set forth in claim 6, wherein the material of the adhesive insulating layer is made of either one of an oxide or a nitride of at least one element selected from composite element of the piezoelectric layer.

8. The ink jet recording head as set forth in claim 7, wherein the adhesive insulating layer is made of zirconium oxide.

9. The ink jet recording head as set forth in claim 6, wherein the insulating layer is made of the adhesive insulating layer.

10. The ink jet recording head as set forth in claim 9, wherein the insulating layer is formed directly on a silicon monocrystalline substrate.

11. The ink jet recording head as set forth in claim 9, wherein the insulating layer is formed on a silicon dioxide film formed on the silicon monocrystalline substrate, and wherein the portions of the silicon dioxide film corresponding to the pressure generating chambers are removed.

12. The ink jet recording head as set forth in claim 6, wherein the piezoelectric layer is made of PZT and the adhesive insulating layer is made of zirconium oxide.

13. The ink jet recording head as set forth in claim 2, wherein both ends of the piezoelectric layer in a width direction thereof are positioned in the area facing the pressure generating chamber.

14. The ink jet recording head as set forth in claim 2, wherein the piezoelectric layer is extended to areas corresponding to peripheral walls on both sides in the width direction of the pressure generating chamber, and wherein a portion of the piezoelectric layer on the lower electrode is thicker than any other area thereof.

15. The ink jet recording head as set forth in claim 2, wherein relationship among width $W_{TE}$ of the upper electrode, width $W_{BE}$ of the lower electrode, and thickness T of the piezoelectric layer satisfies $$(W_{BE}-5T)<W_{TE}<(W_{BE}+5T).$$

16. The ink jet recording head as set forth in claim 2, wherein the end of the active part of the piezoelectric element is positioned inside from the peripheral wall of the pressure generating chamber.

17. The ink jet recording head as set forth in claim 2, wherein a discontinuous lower electrode film discontinuous with the lower electrode is provided in an area facing the boundary between an end and peripheral wall of the pressure generating chamber.

18. The ink jet recording head as set forth in claim 17, wherein a wiring lower electrode, which is made discontinuous with the discontinuous lower electrode and is connected at one end to external wiring, is provided for each piezoelectric element.

19. The ink jet recording head as set forth in claim 17, wherein a second insulating layer is provided on the outside of the end of the lower electrode.

20. The ink jet recording head as set forth in claim 19, wherein the second insulating layer has substantially the same film thickness as the lower electrode.

21. The ink jet recording head as set forth in claim 19, wherein the second insulating layer is made of an insulating material different from that of the insulating layer.

22. The ink jet recording head as set forth in claim 17, wherein a thick film part is provided on the insulating layer on the outside of the end of the lower electrode.

23. The ink jet recording head as set forth in claim 22, wherein the thick film part has substantially the same film thickness as the lower electrode.

24. The ink jet recording head as set forth in claim 17, wherein a film tapering part where film thickness of the lower electrode is gradually decreased toward the outside of the active part of the piezoelectric element is provided at the end of the lower electrode.

25. The ink jet recording head as set forth in claim 24, wherein the film tapering part forms a slope where the film thickness of the lower electrode is gradually decreased.

26. The ink jet recording head as set forth in claim 24, wherein the film tapering part is a part where the film thickness of the lower electrode is gradually decreased stepwise.

27. The ink jet recording head as set forth in claim 24, wherein the film tapering part forms a slanting curved surface where the film thickness of the lower electrode is gradually decreased continuously.

28. The ink jet recording head as set forth in claim 24, wherein the piezoelectric layer formed on the film tapering part is thicker than any other portion.

29. The ink jet recording head as set forth in claim 17, wherein the other end of the active part of the piezoelectric element has a similar structure to that of the one end thereof.

30. The ink jet recording head as set forth in claim 17, wherein the other end of the active part of the piezoelectric element is formed by the ends of the piezoelectric layer and the upper electrode and is covered with a discontinuous piezoelectric layer discontinuous with the piezoelectric layer.

31. The ink jet recording head as set forth in claim 17, wherein the other end of the active part of the piezoelectric element is formed by the ends of the piezoelectric layer and the upper electrode and is fixed with an adhesive.

32. The ink jet recording head as set forth in claim 2, wherein the lower electrode is extended from the other end of the active part of the piezoelectric element to the top of the peripheral wall of the pressure generating chamber.

33. The ink jet recording head as set forth in claim 32, wherein the lower electrode has a wider part at least wider than the pressure generating chamber in an area facing the proximity of one end portion of the pressure generating chamber, and wherein the wider part is extended from the end portion in the longitudinal direction of the pressure generating chamber to the top of the peripheral wall thereof.

34. The ink jet recording head as set forth in claim 2, wherein the piezoelectric layer, and one of the upper electrode and a lead electrode connected onto the upper electrode are extended from the longitudinal direction of the area facing the pressure generating chamber to the outside thereof.

35. The ink jet recording head as set forth in claim 34, wherein the direction that the lower electrode extends to the top of the peripheral wall differs from the direction that the piezoelectric layer, and one of the upper electrode and the lead electrode connected onto the upper electrode extend to the top of the peripheral wall.

36. The ink jet recording head as set forth in claim 35, wherein either one of the lower electrode or the upper electrode is a common electrode.

37. The ink jet recording head as set forth in claim 34, wherein the direction that the lower electrode extends to the top of the peripheral wall is the same as the direction that the piezoelectric layer, and one of the upper electrode and the lead electrode connected onto the upper electrode extend to the top of the peripheral wall.

38. The ink jet recording head as set forth in claim 37, wherein one of the lower electrode and the upper electrode is a common electrode.

39. The ink jet recording head as set forth in claim 2, wherein the lower electrode is extended from the proximity of at least one end portion in a longitudinal direction of the area facing the pressure generating chamber to the outside in the width direction thereof to form a common electrode.

40. The ink jet recording head as set forth in claim 2, wherein the piezoelectric layer and the upper electrode are patterned in batch.

41. The ink jet recording head as set forth in claim 2, wherein both ends of the piezoelectric layer in the longitudinal direction thereof are patterned so as to be in the areas facing the pressure generating chambers, and wherein the upper electrode is continuously formed so as to cross the pressure generating chambers in the width direction to form a common electrode.

42. The ink jet recording head as set forth in claim 2, wherein a remaining part made of the same layer as the lower electrode is provided on tops of partitions on both sides in the width direction of the pressure generating chamber.

43. The ink jet recording head as set forth in claim 42, wherein a discontinuous lower electrode discontinuous with the lower electrode is provided on the outside of one end portion of the active part of the piezoelectric element, and wherein the remaining part is continuously extended from the discontinuous lower electrode.

44. The ink jet recording head as set forth in claim 42, wherein the remaining part is provided continuously with the lower electrode forming a part of the piezoelectric element.

45. The ink jet recording head as set forth in claim 42, wherein spacing between an end face in the width direction of the lower electrode and an end face in a width direction of the remaining part is wider than the thickness of the piezoelectric layer and is narrower than the width of the lower electrode.

46. The ink jet recording head as set forth in claim 42, wherein an end in a longitudinal direction of the piezoelectric layer is disposed in the proximity of the end portion of the pressure generating chamber where the lower electrode is extended to the top of the peripheral wall, and wherein the distance from that end to a part where the lower electrode extended to the outside becomes wider is wider than the thickness of the piezoelectric layer and is narrower than the width of the lower electrode.

47. The ink jet recording head as set forth in claim 42, wherein the remaining part has a width which is not less than 50% of the width of the partition between the adjacent pressure generating chambers.

48. The ink jet recording head as set forth in claim 42, wherein the lower electrode and the remaining part are formed in an area of a width of not less than 50% of the area corresponding to the pressure generating chambers and the partitions.

49. The ink jet recording head as set forth in claim 42, wherein the lower electrode and the remaining part are formed in an area of not less than 50% of all area of a flow passage formation substrate.

50. The ink jet recording head as set forth in claim 2, wherein the crystalline structure of the piezoelectric layer on the lower electrode is substantially the same as that on the insulating layer.

51. The ink jet recording head as set forth in claim 50, wherein crystal seed as a nucleus of crystal of the piezoelectric layer is formed on a surface of the insulating layer.

52. The ink jet recording head as set forth in claim 51, wherein the crystal seed is formed like islands.

53. The ink jet recording head as set forth in claim 2, wherein the pressure generating chambers are formed by anisotropic etching and the lower electrode, piezoelectric, and upper electrode layers are formed by film formation and lithography method.

54. An ink jet recording apparatus comprising an ink jet recording head as set forth in any of claims 2 to 15 and 16 to 53.

* * * * *